US007389067B2

(12) United States Patent
Okamoto et al.

(10) Patent No.: US 7,389,067 B2
(45) Date of Patent: Jun. 17, 2008

(54) DEVELOPER CARTRIDGE OF AN IMAGE FORMING APPARATUS FOR REMOVABLY MOUNTING

(75) Inventors: Masaya Okamoto, Niigata (JP); Kazuaki Iikura, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/713,592

(22) Filed: Mar. 5, 2007

(65) Prior Publication Data

US 2007/0154237 A1 Jul. 5, 2007

Related U.S. Application Data

(62) Division of application No. 10/886,573, filed on Jul. 9, 2004, now Pat. No. 7,212,774.

(30) Foreign Application Priority Data

Dec. 3, 2003 (JP) ..... P2003-404997

(51) Int. Cl.
*G03G 15/08* (2006.01)

(52) U.S. Cl. ..... 399/120; 399/227

(58) Field of Classification Search ..... 399/111, 399/112, 119, 120, 227, 262, 359, 360; 222/DIG. 1
See application file for complete search history.

(56) References Cited

U.S. PATENT DOCUMENTS 5,479,247 A * 12/1995 Watanabe et al. ..... 399/120
5,506,665 A 4/1996 Ishida et al. ..... 355/260
5,568,237 A 10/1996 Ishida et al. ..... 355/260
5,752,141 A * 5/1998 Nishimura et al. ..... 399/227
6,032,002 A * 2/2000 Yokomori et al. ..... 399/12
6,134,410 A * 10/2000 Nakajima ..... 399/262
6,185,396 B1 2/2001 Aizawa et al.

(Continued)

FOREIGN PATENT DOCUMENTS

CN 2570829 Y 9/2003

(Continued)

*Primary Examiner*—Robert Beatty
(74) *Attorney, Agent, or Firm*—Morgan, Lewis & Bockius LLP

(57) ABSTRACT

A developer cartridge is constituted to be mounted attachably and detachably in a directional orthogonal to a rotating shaft of a developing unit main body and the developer cartridge has a developer containing portion and a developer recovery portion for recovering used developer from the developing unit. A supply port opens to supply the developer from the developer containing portion and a recovery port opens in the developer recovery portion to recover used and recovered developer. A supplying opening portion is formed in a shutter member at a position corresponding to the supply port and a recovering portion is formed in the shutter member at a position corresponding to the recovery port. The shutter member opens and closes both the supply port and the recovery port. A handle for operating the shutter member is configured so that it is contained in the rotating outer peripheral surface of the developing unit main body when the supply port and the recovery port are opened and so that it projects toward the outside of the rotating outer peripheral surface of the developing unit main body when the supply port and the recovery port are closed. The handle is also used to mount the developer cartridge on the developer unit main body.

8 Claims, 18 Drawing Sheets

U.S. PATENT DOCUMENTS

| | | | | |
|---|---|---|---|---|
| 6,282,395 | B1 | 8/2001 | Nittani et al. | 399/284 |
| 6,292,644 | B1 | 9/2001 | Goto et al. | 399/262 |
| 6,314,255 | B1 | 11/2001 | Yokomori et al. | 399/199 |
| 6,535,705 | B2 | 3/2003 | Asakura et al. | |
| 6,804,484 | B2 * | 10/2004 | Hashimoto et al. | 399/120 |
| 6,920,301 | B2 * | 7/2005 | Arimoto | 399/227 |
| 6,931,228 | B2 | 8/2005 | Tanaka et al. | |
| 6,983,115 | B2 | 1/2006 | Isobe et al. | |
| 7,079,788 | B2 * | 7/2006 | Ban et al. | 399/120 |
| 7,146,124 | B2 | 12/2006 | Okamoto et al. | 399/227 |
| 7,212,774 | B2 * | 5/2007 | Okamoto et al. | 399/227 |
| 2002/0021909 | A1 | 2/2002 | Harumoto | 399/27 |
| 2003/0215261 | A1 | 11/2003 | Karakama et al. | |
| 2003/0223782 | A1 | 12/2003 | Ban et al. | |

FOREIGN PATENT DOCUMENTS

| | | | |
|---|---|---|---|
| JP | 07-181793 | | 7/1995 |
| JP | 7-306578 | | 11/1995 |
| JP | 07-325479 | | 12/1995 |
| JP | 08-015971 | | 1/1996 |
| JP | 09-043982 | | 2/1997 |
| JP | 09-281873 | | 10/1997 |
| JP | 09-292764 | | 11/1997 |
| JP | 10-198145 | | 7/1998 |
| JP | 10247011 | A * | 9/1998 |
| JP | 11-73019 | | 3/1999 |
| JP | 11-282251 | | 10/1999 |
| JP | 2000-162861 | | 6/2000 |
| JP | 2001-083765 | | 3/2001 |
| JP | 2001-083766 | | 3/2001 |
| JP | 2001-228696 | | 8/2001 |
| JP | 2003-307925 | | 10/2003 |
| JP | 2003-316138 | | 11/2003 |
| KR | 2003-0089391 | | 11/2003 |

* cited by examiner

DEVELOPER CARTRIDGE OF AN IMAGE FORMING APPARATUS FOR REMOVABLY MOUNTING

CROSS REFERENCE TO RELATED APPLICATION

This application is a divisional of application Ser. No. 10/886,573, filed Jul. 9, 2004, now issued as U.S. Pat. No. 7,212,774, issued May 1, 2007, which is incorporated herein by reference.

BACKGROUND OF THE INVENTION

1. Field of the Invention

The present invention relates to an image forming apparatus of a copier, a printer, a facsimile or a composite machine thereof in full color applied with an electrophotography system. In particular, the present invention relates to an image forming apparatus capable of preventing a developer cartridge used in the image forming apparatus from being mistakenly installed or removed.

2. Description of the Related Art

In an image forming apparatus of this kind of a copier, a printer, a facsimile or a composite machine thereof or the like in full color applied with an electrophotography system, there is an image forming apparatus of so-called tandem type constituted such that a plurality of image forming portions in correspondence with respective colors of yellow, magenta, cyan, black and the like are arranged in parallel, and toner images of respective colors of yellow, magenta, cyan, black and the like formed at the respective image forming portions are directly transferred onto a record sheet, or secondarily transferred onto a record sheet via an intermediate transferring belt or similar means to thereby form an image in full color.

Further, in an image forming apparatus of a copier, a printer or the like in full color, mentioned above, there is an image forming apparatus of so-to-speak 4 cycle type constituted such that a plurality of developing units with respective colors of yellow, magenta, cyan, black and the like are arranged along the periphery of a developing unit main body contiguously to a single photosensitive drum, the developing units of the respective colors are moved to a developing position opposed to the photosensitive drum by rotating the developing unit main body, and rotating the photosensitive drum by a predetermined number of times to thereby form toner images of the respective colors of yellow, magenta, cyan, and black on the photosensitive drum, and the toner images of the respective colors of yellow, magenta, cyan, and black formed on the photosensitive drum are directly transferred onto a record sheet or secondarily transferred onto a record sheet via an intermediate transferring belt or similar means to thereby form an image in full color.

In the image forming apparatus of the tandem type and the 4 cycle type, the image forming apparatus of the 4 cycle type is characterized in being able to be downsized since only the single photosensitive drum is used.

There have already been proposed technologies with regard to the 4 cycle image forming apparatus disclosed in, for example, JP-A-2001-83765 and JP-A-2001-83766.

A color image recording apparatus according to JP-A-2001-83765, mentioned above, includes a rotating member arranged to assemble with a plurality of developing units including toner containing portions and developing rollers substantially in a circular ring shape in a state of disposing the developing rollers always on an outer peripheral side and rotating to move the developing units to an image forming position, and a photosensitive member containing unit integrally including a photosensitive member, a charging roller for charging the photosensitive member, and a cleaner portion for cleaning to recover a toner remaining on the photosensitive member for transferring an image developed on the photosensitive member by the developing roller to a record sheet via an intermediate transferring member. Whereas the developing unit is inserted into the apparatus from a lid portion of an upper face of the apparatus in the vicinity of the developing roller on the upper side of the rotating member from a direction orthogonal to an axis of the rotating member, the photosensitive member containing unit is inserted into the apparatus from an opening and closing position on a front side of the apparatus and guided to the image forming apparatus from a direction orthogonal to the developing roller, and constituted to carry out two kinds of rotation controls for rotating the rotating member by 90° at respective steps of forming images of the respective colors and rotating the rotating member to dispose the developing unit at the interchanging position when there is not the toner of any of the developing units.

Further, a color image recording apparatus according to JP-A-2001-83766, mentioned above, is a color image recording apparatus including a rotating member arranged to assemble a plurality of developing units having toner containing portions and developing rollers substantially in a circular ring shape in a state of disposing the developing rollers always on an outer peripheral side and rotating to move the developing units successively to an image forming position, and a photosensitive member containing unit constituted by integrally including a photosensitive member, a charging roller for charging the photosensitive member, a cleaner portion for cleaning to recover toner remaining on the photosensitive member for transferring an image developed on the photosensitive member by the developing rollers to a record sheet via an intermediate transferring member. Whereas the developing unit is inserted into the apparatus from a lid portion at an upper face of the apparatus to be mounted to the rotating member from a direction orthogonal to an axis of the rotating member, the photosensitive member containing unit is constituted to be inserted into the apparatus from an opening and closing portion on a front side of the apparatus to be guided to the image forming position from a direction orthogonal to the developing roller and constituted to be able to be able to simultaneously contain the toner remaining on the intermediate transferring member to the cleaner portion.

In the case of the color image recording apparatus according to JP-A-2001-83765 and JP-A-2001-83766, mentioned above, as shown in FIG. 27, the apparatus are constituted such that when any of developing units 100 runs out of toner, a rotating member 101 arranged with the four developing units 100 is rotated to move the developing unit 100 in which the toner is not present is moved to an interchanging position and the developing unit 100 is interchanged by opening a lid portion 102 at an upper face of the apparatus.

A developer cartridge is configured to supply a toner-containing developer, and for removable mounting in one of a plurality of a developing units that are disposed along a rotating outer peripheral surface of a developing unit main body. The developer cartridge includes a developer containing portion that contains the developer supplied to a developing unit; a developer recovery portion disposed at one end of the developer containing portion in a longitudinal direction, that recovers used developer from the developing unit; a supply port that opens to supply the developer from the developer containing portion to the developing unit; a recovery port that opens in the developer recovery portion to recover the used and recovered developer from the developing unit; a shutter member in which a supplying opening portion is formed at a position corresponding to the recovery port, the shutter member opening the supply port and the recovery port, and the shutter member closing the supply port and the recovery port; and a handle that operates the shutter member, the handle configured so that it is contained in the rotating outer peripheral surface of the developing unit main body when the supply port and the recovery port are opened, the handle configured so that it projects toward the outside of the rotating outer peripheral surface of the developing unit main body when the supply port and the recovery port are closed; and the handle further used to mount the developer cartridge on the developer unit main body.

Another aspect of the invention provides a developer cartridge wherein the shutter member is formed in a cylindrical shape that is rotatably fitted to an outer periphery of the developer containing portion and a developer recovery portion.

Further, the handle may be configured to project outwardly in a radial direction from an outer peripheral surface of the shutter member.

Further, the handle may be integrated with the shutter member.

Further, developer recovery portion may be continuously provided to the end of the developer containing portion and the developer recovery portion and the developer containing portion may be partitioned with a partitioning cap.

Further, the developer cartridge may be removably mounted on one of the plurality of developing units in a direction vertical to a rotating axis of the developing unit main body.

Further, outer member may open the supply port and the recovery port simultaneously.

Further, the shutter member may close the supply port and the recovery port simultaneously.

DETAILED DESCRIPTION OF THE PREFERRED EMBODIMENTS

An explanation will be given of embodiments of the invention in reference to the drawings as follows.

Embodiment 1

Figure 2:
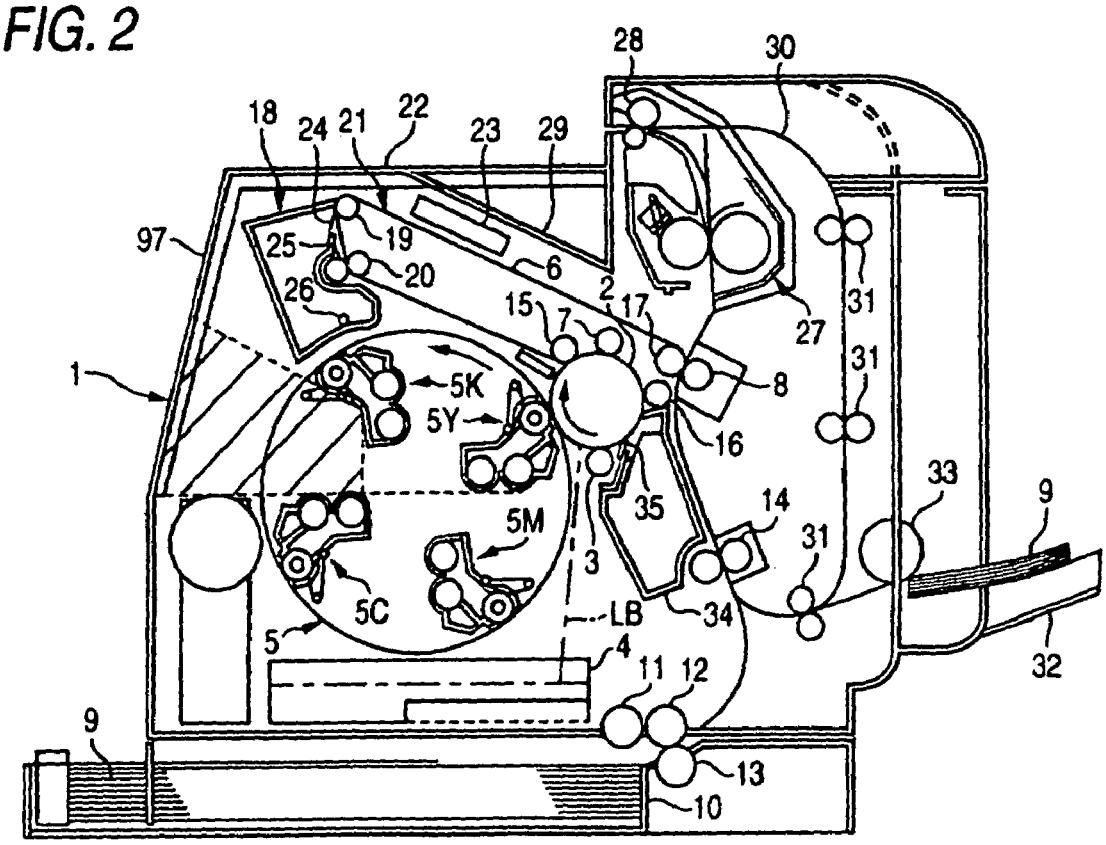
FIG. 2 is a section view showing the full color printer of the image forming apparatus according to Embodiment 1 of the invention.

FIG. 2 shows a full color printer of a 4 cycle type of an image forming apparatus according to Embodiment 1 of the invention.

In FIG. 2, reference numeral 1 designates a main body of the full color printer and a photosensitive drum 2 as an image carrier is rotatably arranged at a slightly right upper portion from a center at inside of the full color printer 1. The photosensitive drum 2 comprises a conductive cylindrical member having a diameter of about 47 mm coated with a photosensitive layer comprising organic photoconductor (OPC) or the like at a surface thereof and is driven to rotate at a process speed of about 150 mm/sec along an arrow mark direction by driving means, not illustrated. A surface of the photosensitive drum 2 is charged to a predetermined potential by a charging roll 3 as charging means arranged substantially right below the photosensitive drum 2 and thereafter subjected to image exposure by laser beam (LB) by ROS4 (Raster Output Scanner) as exposing means arranged at a remote position similarly right below the photosensitive drum 2 to form an electrostatic latent image in accordance with image information. The electrostatic latent image formed on the photosensitive drum 2 is developed by a rotating type developing unit 5 arranged with developing units 5Y, 5M, 5C, 5K of respective colors of yellow (Y), magenta (M), cyan (C), black (K) along a peripheral direction to constitute a toner image of a predetermined color.

Respective steps of charging, exposing and developing are repeated at the surface of the photosensitive drum 2 a predetermined number of times in accordance with the color of the image to be formed. According to the rotating type developing unit 5, the developing units 5Y, 5M, 5C, 5K of corresponding colors are moved to a developing position opposed to the photosensitive drum 2. For example, when an image in full color is formed at the surface of the photosensitive drum 2, the respective steps of charging, exposing and developing are repeated 4 times corresponding to the respective colors of yellow (Y), magenta (M), cyan (C), black (K) and toner images corresponding to the respective colors of yellow (Y), magenta (M), cyan (C), black (K) are successively formed on the surface of the photosensitive drum 2. In forming the toner images, although the number of times of rotating the photosensitive drum 2 differs in accordance with a size of the image, for example, when the size is A4 size, one image is formed by rotating the photosensitive drum 2 by 3 times. That is, at each time of rotating the photosensitive drum 2 by 3 times, the toner images in correspondence with the respective colors of yellow (Y), magenta (M), cyan (C), black (K) are successively formed on the surface of the photosensitive drum 2.

The toner images of the respective colors of yellow (Y), magenta (M), cyan (C), black (K) successively formed on the photosensitive drum 2 are primarily transferred by a primary transferring roll 7 at a primary transferring position at which an intermediate transferring belt 6 as an intermediate transferring member is made to wrap on an outer periphery of the photosensitive drum 2 in a state of being overlapped by each other on the intermediate transferring belt 6. The toner images of yellow (Y), magenta (M), cyan (C), black (K) multiplexedly transferred on the intermediate transferring belt 6 are secondarily transferred onto record sheet 9 by a secondary transferring roll 8. The record sheet 9 is fed from a sheet feeding cassette 10 arranged at a lower portion of the full color printer main body 1 by a pickup roll 11, fed by a feed roll 12 and a retard roll 13 in a state of being separated sheet by sheet, and carried to a secondary transferring position of the intermediate transferring belt 6 in a state of being synchronized with the toner images transferred onto the intermediate transferring belt 6 by a resist roll 14.

The intermediate transferring belt 6 is hung by a plurality of rolls and driven in accordance with rotation of, for example, the photosensitive drum 2 to move to circulate by a predetermined process speed (about 150 mm/sec). The intermediate transferring belt 6 is hung by a predetermined tension by a wrap in roll 15 specifying a wrap position of the intermediate transferring belt 6 on the upstream side in a direction of rotating the photosensitive drum 2, the primary transferring roll 7 for transferring the toner images formed on the photosensitive drum 2 onto the intermediate transferring belt 6, a wrap out roll 16 for specifying the wrap position of the intermediate transferring belt 6 on the downstream side of the wrap position, a backup roll 17 brought into contact with the secondary transferring roll 8 via the intermediate transferring belt 6, a first cleaning backup roll 19 and a second cleaning backup roll 20 opposed to a cleaning unit 18 of the intermediate transferring belt 6.

Further, although the intermediate transferring belt 6 is hung by the plurality of rolls 7, 15 through 17, 19, 20 as described above, according to the embodiment, in order to downsize the full color printer main body 1, a sectional shape of hanging the intermediate transferring belt 6 is constituted to be substantially a flat and slender trapezoidal shape.

Meanwhile, according to the embodiment, in an image forming apparatus including a rotating type developing unit which includes a developing unit main body which is rotatable, a plurality of developing units disposed along a direction of rotation of the developing unit main body and at least one developer cartridge which is disposed along the direction of rotation of the developing unit main body and supplies a developer to the developing unit, an image forming unit which includes at least one image carrier which is disposed to be opposed to at least a portion of the developer cartridge and constituted to be installable and removable into and out of the image forming apparatus, a cover making the developer cartridge installable and removable at the position of interchanging the developer cartridge in a state of being mounted with the image forming unit and an operation hampering member which hampers at least a portion of the developer cartridge which is not disposed at an interchanging position from being operated in a direction of closing a supply port of the developer cartridge, the image forming apparatus is characterized in that the developer cartridge is mounted to be installable and removable in a direction orthogonal to a rotating shaft of the developing unit main body and opening and closing the supply port which supplies the developer to the developing unit by operating at least a portion of the developer cartridge.

Further, according to the embodiment, at least a portion of the developer cartridge for opening and closing the supply port is a handle provided at an opening and closing member for opening and closing the supply port.

Further, according to the embodiment, at least a portion of the image forming unit is disposed along a rotating outer peripheral face of the rotating type developing unit.

Further, according to the embodiment, the operation hampering member includes a projection provided at the vicinity of one end portion in an axial direction of the rotating type developing unit and extended from the image forming apparatus main body along a longitudinal direction of the developer cartridge.

That is, according to the embodiment, as shown in FIG. 2, a total of the full color printer is downsized as much as possible and a large space of the full color printer main body 1 is occupied by the rotating type developing unit 5. Therefore, the full color printer main body 1 is designed to promote ease of maintenance of the intermediate transferring belt 6, the rotating type developing unit 5 and the like while downsizing the apparatus. Specifically, the image forming unit 21 is constituted integrally by including the photosensitive drum 2, the charging roll 3 and the like, and the total of the image forming unit 21 is configured to be installable and removable into and out of the full color printer main body 1 by opening an upper cover 22 as an interchanging cover of the full color printer main body 1. Further, an upper portion of the intermediate transferring belt 6 is arranged with a position sensor 23 including a reflecting type photosensor for detecting a patch of the toner formed on the intermediate transferring belt 6.

Figure 1:
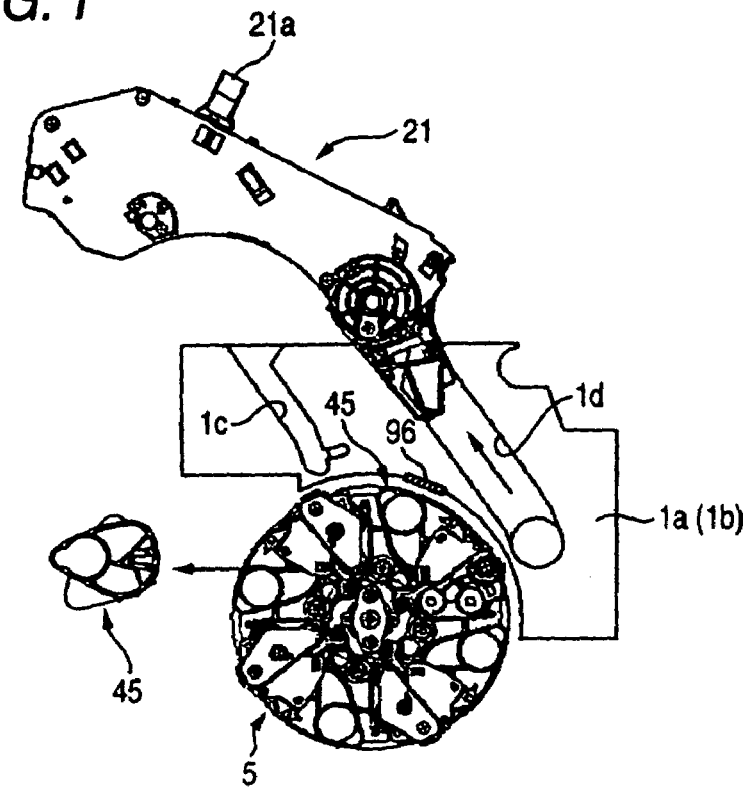
FIG. 1 is a section view showing an essential portion of a full color printer of an image forming apparatus according to Embodiment 1 of the invention.
Figure 3:
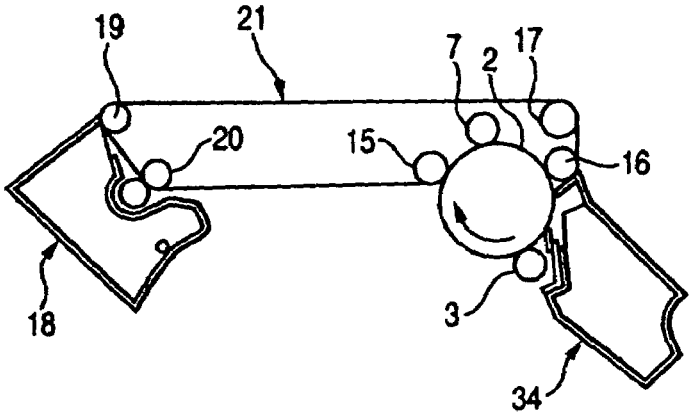
FIG. 3 is a section view showing an image forming unit.

Explaining further, as shown in FIG. 3, the image forming unit 21 is integrally mounted with the photosensitive drum 2, the charging roll 3, the intermediate transferring belt 6, the plurality of rolls 7, 15 through 17, 19, 20 for hanging the intermediate transferring belt 6, the cleaning unit 18 for the intermediate transferring belt 6, and a cleaning unit 34 for the photosensitive drum 2, mentioned later. Further, as shown in FIG. 1, the image forming unit 21 can be taken out of the printer main body 1 by lifting the image forming unit 21 by handle 21*a* provided at an upper portion of the image forming unit 21. Further, inner frames 1*a*, 1*b* arranged on a front side and a rear side of the printer main body 1 in parallel with each other are respectively provided with two guide grooves 1*c*, 1*d* for guiding the image forming unit 1 in attaching and detaching the image forming unit 21. Further, as shown in FIG. 2, the image forming unit 21 is arranged as close as possible along the rotating outer peripheral face of the rotating type developing unit 5 from the cleaning unit 18 for the intermediate transferring belt 6 over to the photosensitive drum 2 in order to downsize the printer main body 1.

Figure 4:
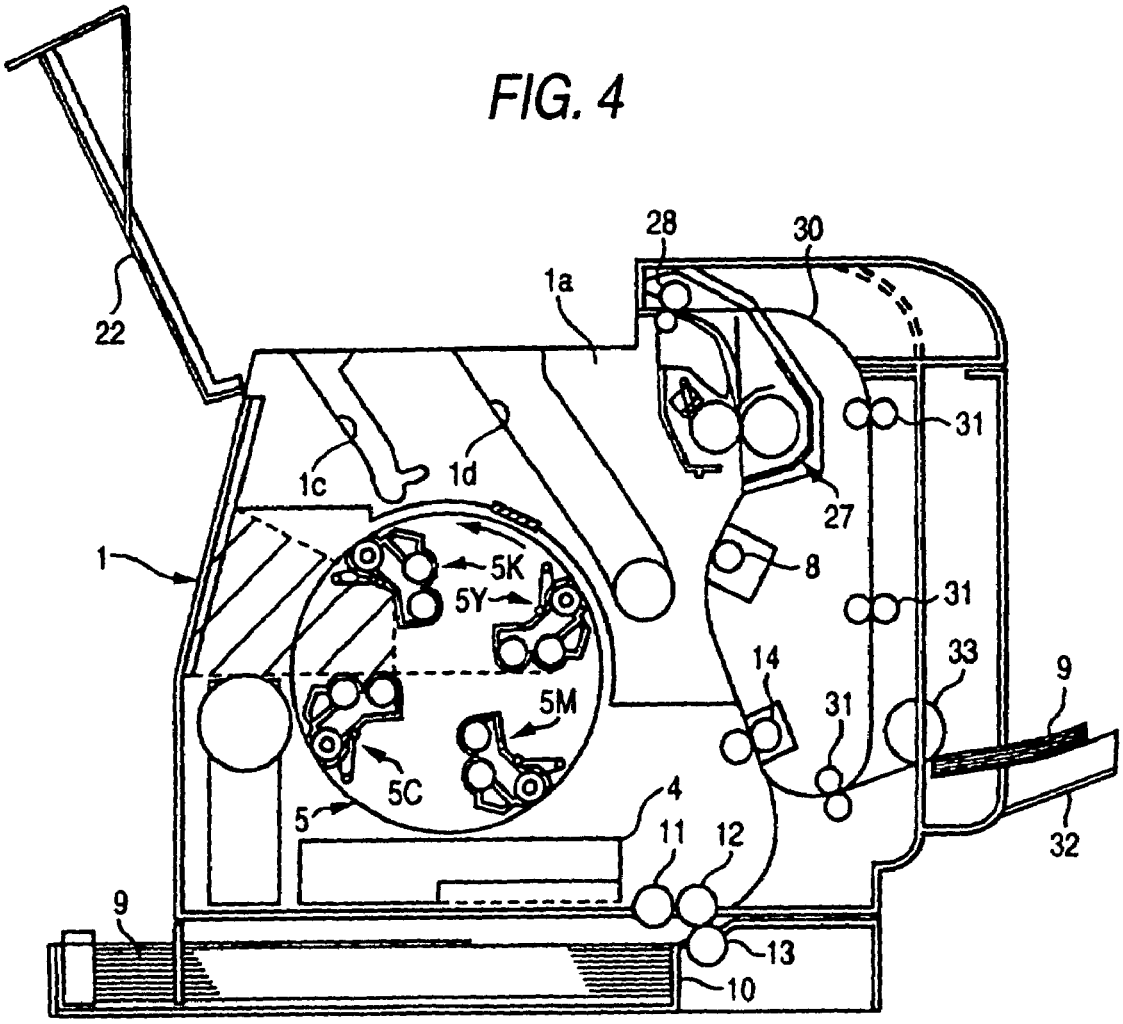
FIG. 4 is a section view showing a state of taking out an image forming unit by opening an interchanging cover of the full color printer of the image forming apparatus according to Embodiment 1 of the invention.

Further, as shown in FIG. 2, as described above, the upper portion of the printer main body 1 is provided with the upper cover 22 as an interchanging cover in order to make the image forming unit 21 installable and removable. According to the printer main body 1, as shown in FIG. 4, when the upper cover 22 is opened, the image forming unit 21 is brought into an exposed state and as shown in FIG. 1, the image forming unit 21 can removed from the printer main body 1 by lifting the image forming unit 21 along two pieces of the guide grooves 1*c*, 1*d* by holding the handle 21*a*. Further, in mounting the image forming unit 21 to the printer main body, contrary to taking out, by gradually moving the image forming unit 21 by fitting portions of the image forming unit 21 to two guide grooves 1*c*, 1*d* by holding the handle 21*a* of the image forming unit 21, as shown in FIG. 2, the image forming unit 21 can be mounted in a predetermined position of the printer main body 1.

Further, as shown in FIG. 2, the cleaning unit 18 of the intermediate transferring belt 6 includes a scraper 24 arranged to be brought into contact with a surface of the intermediate transferring belt 6 hung by the first cleaning backup roll 19 and a cleaning brush 25 arranged to be brought into press contact with the surface of the intermediate transferring belt 6 hung by the second cleaning backup roll 20. The remaining toner and paper powder removed by the scraper 24 and the cleaning brush 25 are recovered to inside of the cleaning unit 18. The cleaning unit 18 is arranged pivotably in the counterclockwise direction of the drawing centering on a pivoting shaft 26, escaped to a position remote from the surface of the intermediate transferring belt 6 until finishing secondary transcription of the toner image of a final color and brought into contact with the surface of the intermediate transferring belt 6 when the secondary transcription of the toner image of the final color is finished.

Further, as shown in FIG. 2, the record sheet 9 transferred with the toner image is carried from the intermediate transferring belt 6 to a fixer 27, the toner image is fixed onto the record sheet 9 by heat and pressure by the fixer 27 and in the case of one face printing, discharged as it is onto a discharge tray 29 provided at an upper portion of the printer main body 1 by a discharge roll 28.

Meanwhile, in the case of both faces printing, the record sheet 9 fixed with the toner image by the fixer 27 is not discharged as it is with single side printing onto the discharge tray 29 by the discharge roll 28 but in a state of pinching a rear end portion of the record sheet 9 by the discharge roll 28, the discharge roll 28 is rotated reversely, a carry path of the record sheet 9 is switched to a sheet carry path 30 for both faces by the carry roll 31 arranged at the sheet carry path 30 for the both faces, in a state of reversing head and tail of the record sheet 9, the record sheet is carried again to the secondary transferring position of the intermediate transferring belt 6 by a carry roll 31 arranged at the sheet carry path 30 for both faces to thereby form an image on a rear face of the record sheet 9.

Further, as shown in FIG. 2, the full color printer is optionally mountable with a hand-inserted tray 32 at a side face of the printer main body 1 openably and closably. The record sheet 9 of arbitrary size and kind mounted on the hand-inserted tray 32 is fed by a feed roll 33 and carried to the secondary transferring position of the intermediate transferring belt 6 via the carry roll 31 and the resist roll 14 to thereby enable forming of the image on the record sheet 9 having arbitrary size and kind.

Further, the surface of the photosensitive drum 2 after finishing the step of transferring the toner image is cleaned of the remaining toner or the like by a cleaning blade 35 of the cleaning unit 34 arranged on a skewed lower side of the photosensitive drum 2 to prepare for a successive image forming step.

Figure 5:
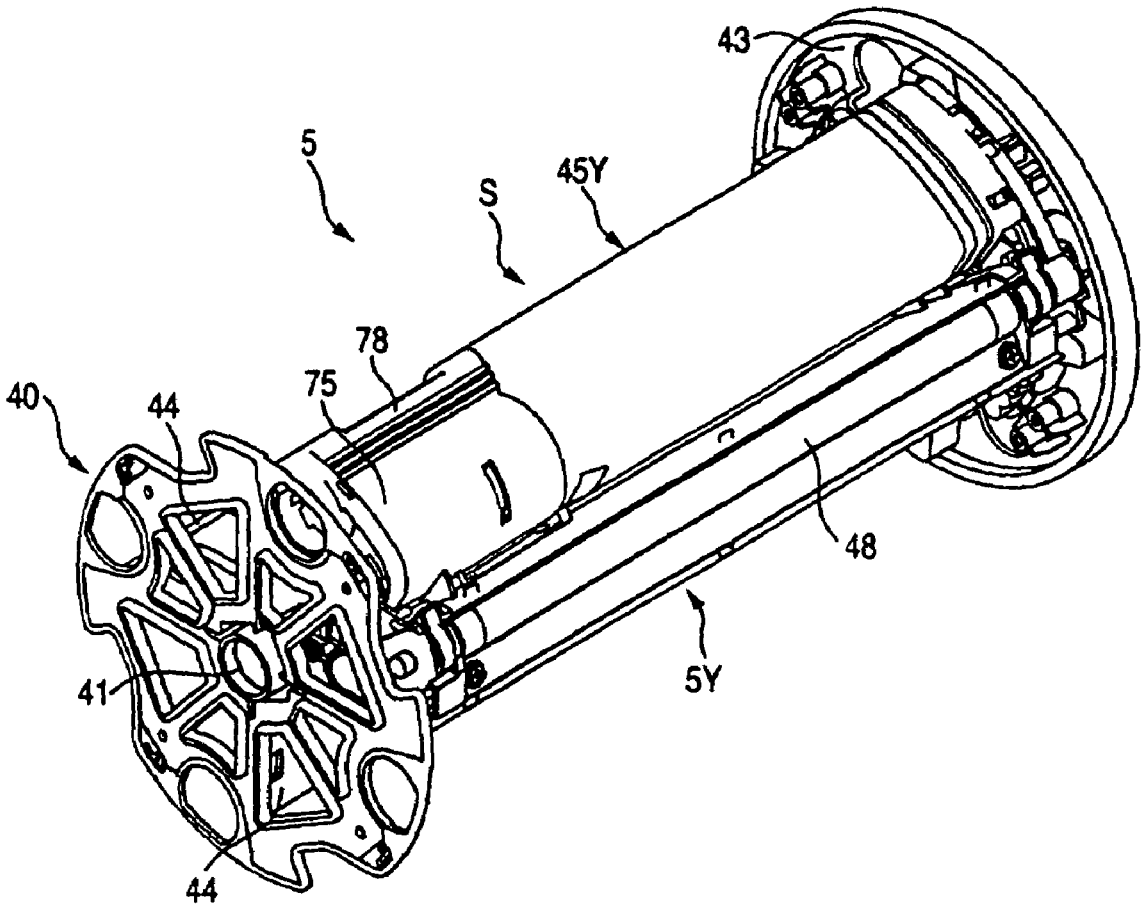
FIG. 5 is a perspective view showing a developing apparatus with a developer cartridge.

FIG. 5 is a perspective view showing a specific example of the rotating type developing unit 5 applied to the image forming apparatus according to the embodiment. Further, for convenience of explanation, FIG. 5 shows one developing unit 5Y and one developer cartridge 45Y at the developing unit main body.

Figure 6:
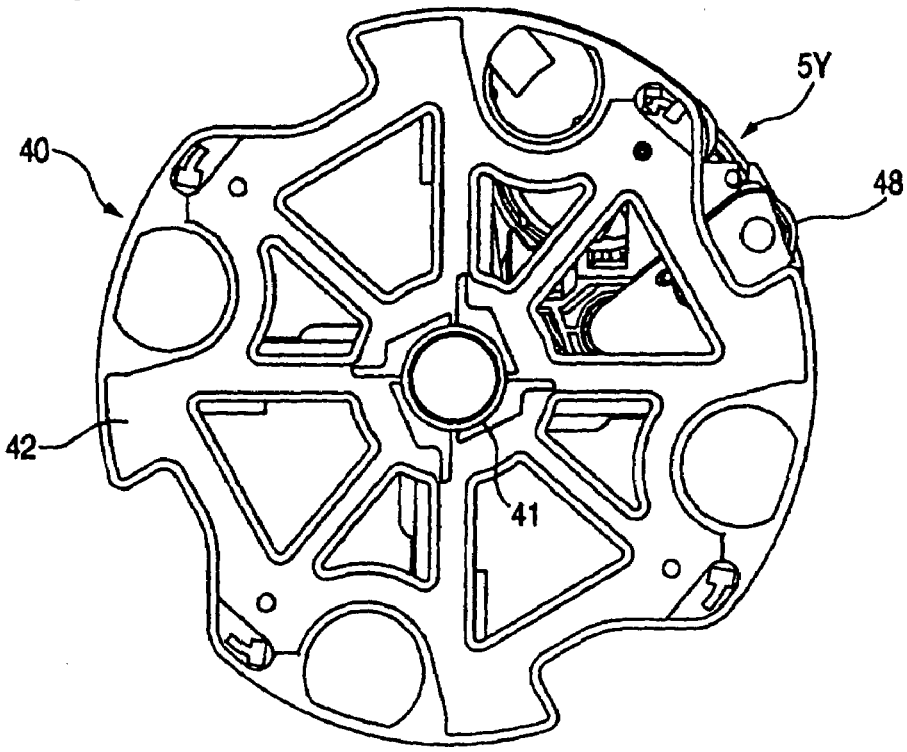
FIG. 6 is a side view showing a developing unit main body.

As shown in FIG. 5 and FIG. 6, the rotating type developing unit 5 is provided with a developing unit main body 40 arranged rotatably. The developing unit main body 40 is provided with a rotating shaft member 41 in a cylindrical shape arranged along a longitudinal direction at a center portion thereof, a flange member 42 on a front side arranged at an end portion on this side in the longitudinal direction of the rotating shaft member 41, a flange member 43 on a rear side arranged at an end portion on a depth side in the longitudinal direction of the rotating shaft member 41, and a partitioning member 44 for partitioning a space S in a cylindrical shape formed by the rotating shaft member 41 and the flange members 42, 43 on the front side and the rear side into four at respective 90 degrees.

Figure 7:
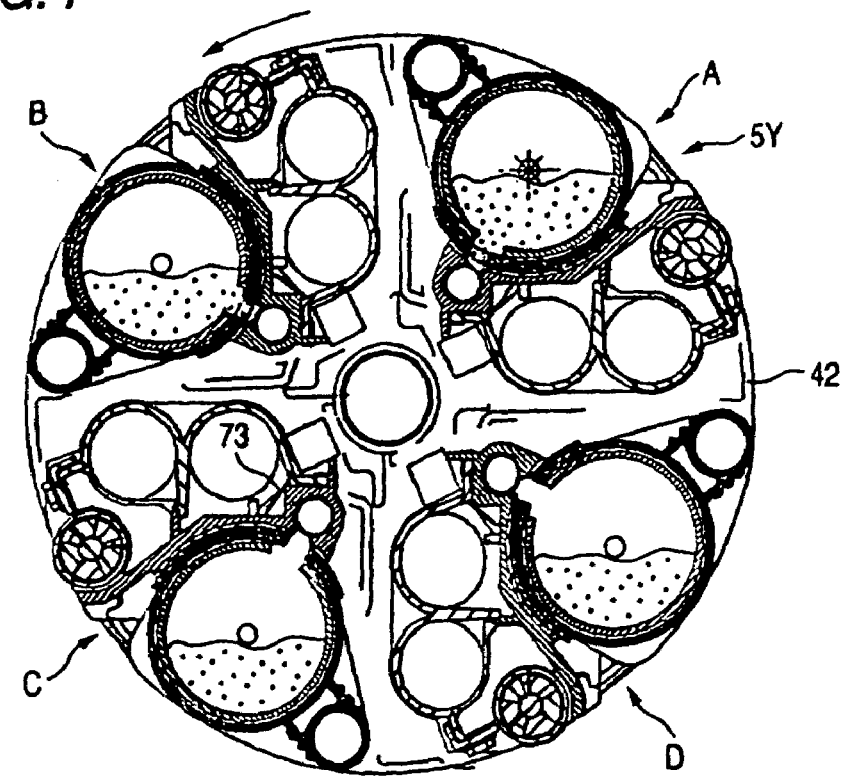
FIG. 7 is a sectional view showing the developing apparatus.

As shown in FIG. 2, the developing unit main body 40 is attached to the printer main body 1 rotatably along the counterclockwise direction centering on the rotating shaft member 41. As shown in FIG. 7, the developing unit main body 40 is mounted with four developing units 5Y, 5M, 5C, 5K of yellow (Y), magenta (M), cyan (C), black (K) along the peripheral direction along the clockwise direction and mounted with four developer cartridges 45Y, 45M, 45C, 45K of yellow (Y), magenta (M), cyan (C), black (K) in correspondence with the developing units 5Y, 5M, 5C, 5K.

Since all of the developing units 5Y, 5M, 5C, 5K are similarly constituted, explaining here by taking an example of the developing unit 5Y of yellow (Y), as shown in FIG. 8, the developing unit 5Y of yellow (Y) is provided with a developing unit main body 46 and the developing unit main body 46 is supplied with new developer from the corresponding developer cartridge 45Y.

Figure 8A:
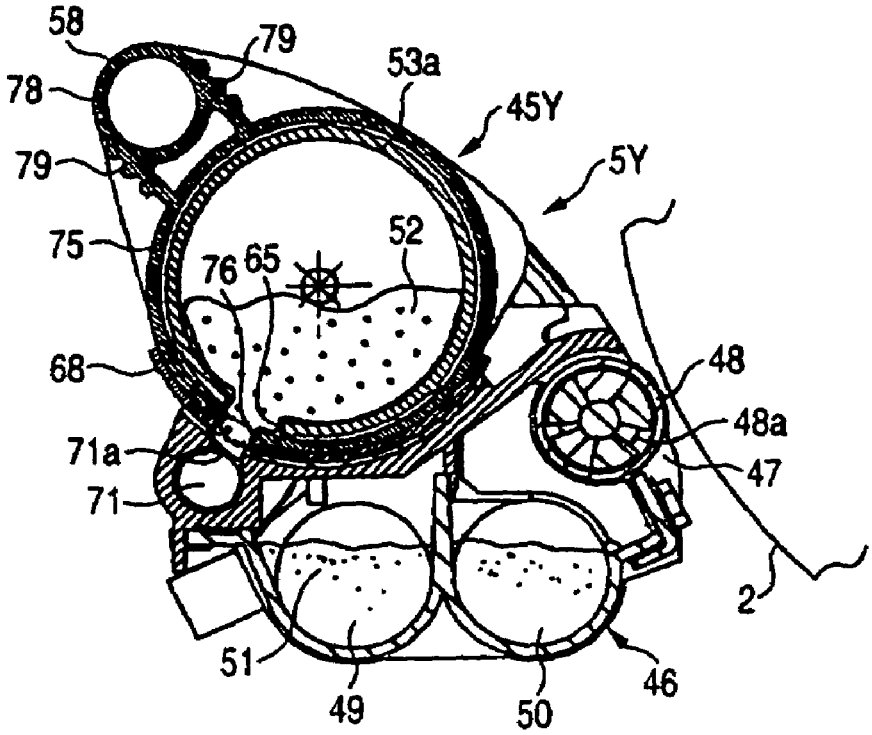
FIGS. 8A and 8B are sectional views showing a developing unit and the developer cartridge of the developing apparatus.

As shown in FIG. 8A, an inside of the developing unit main body 46 is arranged with a developing roll 48 prolonged in a direction vertical to paper face, and two pieces of spiral augers 49, 50 disposed on a rear side in a skewed lower direction of the developing roll 48 and extended in parallel with the developing roll 48. As shown in FIG. 9, the developing roll 48 is arranged substantially over an entire length of the developing unit main body 46. In the developing unit 5Y, as shown in FIG. 8, when the developing roll 48 is rotated, the spiral auger 49 on the depth side carries a developer 51 contained in the developing unit main body 46 while agitating the developer 51 in a direction vertical to paper face. Meanwhile, the spiral auger 50 carries the developer 51 while agitating the developer 51 in a direction reverse to the direction of carrying the developer 51 of the spiral auger 49 to thereby uniformly supply the developer 51 to the developing roll 48. The developer 51 supplied to the surface of the developing roll 48 is carried to a developing region opposed to the photosensitive drum 2 in accordance with the rotation of the developing roll 48 by restricting a film thickness thereof by a film thickness restricting member 52. Further, although according to the embodiment, the developer 51 is comprised of two components including a toner and a carrier, the developer 51 may also include the toner and a developer of one component including only the toner may naturally be used.

As shown in FIG. 8, the developing roll 48 adsorbs the carrier included in the developer 51 by a magnetic force by a magnetic roll 48*a* arranged in a state of being fixed to inside thereof to form a magnetic brush of the developer 51 at a surface of the developing roll 48 to carry the toner adsorbed to the carrier to the developing region opposed to the photosensitive drum 2. Further, the electrostatic latent image formed on the photosensitive drum 2 is visualized by the magnetic brush of the developer 51 comprising the carrier and the toner formed on the surface of the developing roll 48.

Further, the developer cartridge according to the embodiment is constituted by a developer cartridge in which a developing unit main body is arranged rotatably in a vertical face and provided in correspondence with each of a plurality of developing units arranged along a peripheral direction of the developing unit main body for supplying a developer including at least a toner to the corresponding developing units, characterized in that the developer cartridge includes a developer containing portion for containing a new developer and a developer recovering portion extended to one end in a longitudinal direction of the developer containing portion for recovering the used developer recovered from the developing unit, a sectional shape of the developer containing portion is formed in a noncircular shape substantially occupying a total of a space other than the developing unit in a space allocated to one developing unit of the developing unit main body mounted with the developer cartridge, and a sectional shape of the developer recovering portion is formed in a circular shape substantially inscribed to the space other than the developing unit in the space allocated to one developing unit of the developing unit main body mounted with the developer cartridge.

Further, according to the embodiment, the sectional shape of the developer containing portion is constituted to provide two side faces at acute angles to each other.

Further, according to the embodiment, the sectional shape of the developer containing portion is formed substantially in the shape of a tear drop.

Further, the embodiment includes a supply port opened to a side of the developer recovering portion by being communicated with the developer containing portion for supplying the developer to outside, an opening and closing member for opening and closing the supply port, a handle for grabbing when the developer cartridge is attached to and detached from the developing unit main body and the handle is formed integrally with the opening and closing member.

Further, according to the embodiment, the opening and closing member is formed in a cylindrical shape fitted pivotably to an outer periphery of the developer containing portion and the handle is constituted to project from a portion of an outer peripheral face of the opening and closing member to direct externally in a radial direction at a portion of an outer peripheral face of the opening and closing member.

Further, according to the embodiment, in a state in which the developing unit main body is rotatable, the handle is contained in the rotating outer peripheral face of the developing unit main body.

Further, according to the embodiment, the grabbing portion of the handle is constituted to provide non-slip means.

Further, according to the embodiment the developer cartridge is constituted to provide a lock mechanism for preventing the opening and closing member from being pivoted in a direction of opening the supply port in a state of removing the developer cartridge from the developing unit main body.

Further, according to the embodiment, the developer cartridge is constituted to provide a stopper mechanism for preventing the developing unit agent cartridge from being removed from the developing unit main body in a state of opening the supply port by the opening and closing member.

Further, according to the embodiment, the handle is constituted to project to an outer side of the rotating outer peripheral face of the developing unit main body in a state of being able to remove the developer cartridge from the developing unit main body.

Figure 10:
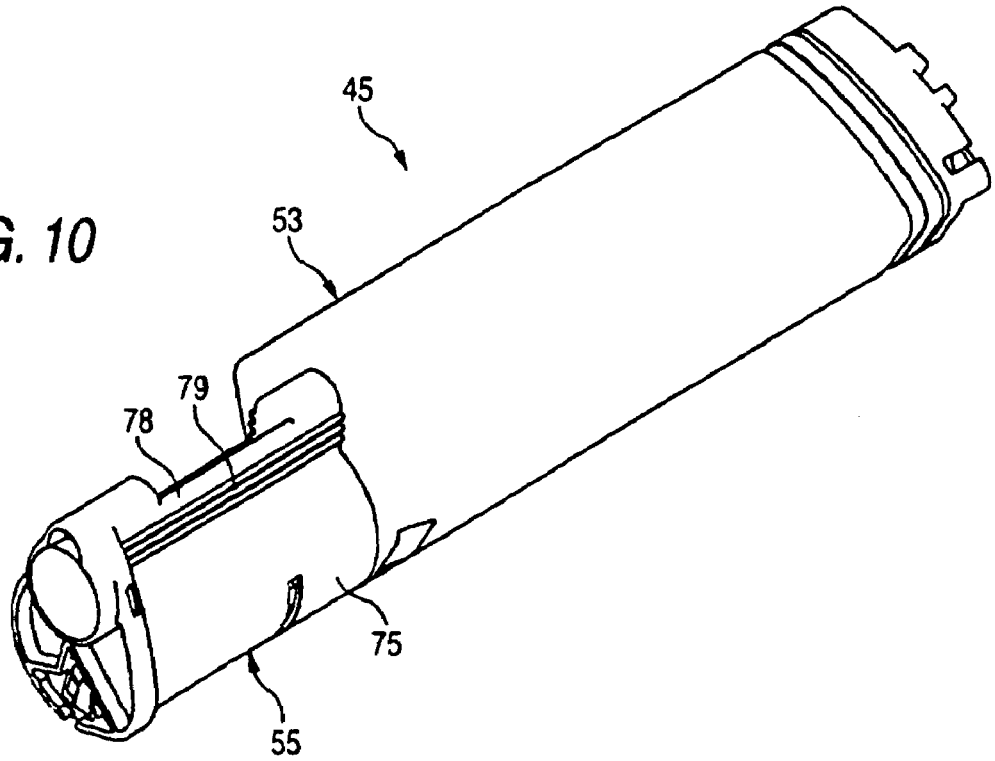
FIG. 10 is a perspective view showing the developer cartridge.
Figure 11A:
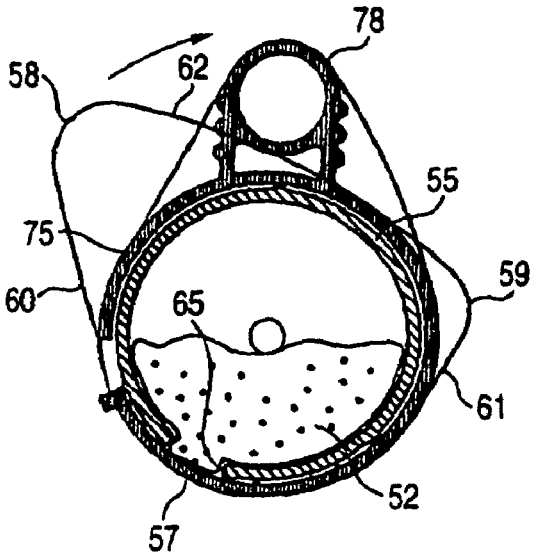
FIGS. 11A to 11C are cross-sectional views showing the developer cartridge.
Figure 11B:
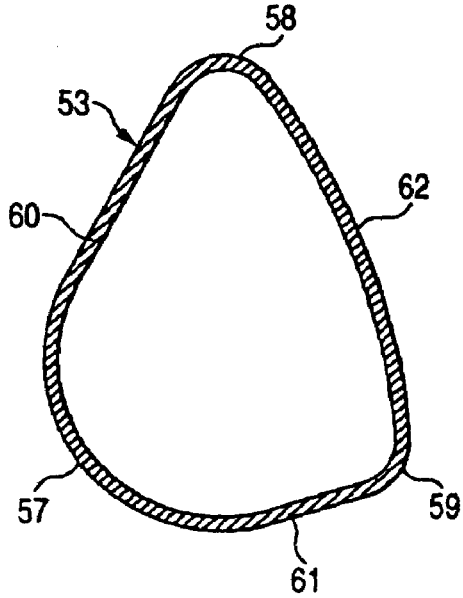

That is, as shown in FIG. 5 and FIG. 10, FIG. 11, the developer cartridge 45 includes a vessel in a shape of a long cylinder in which almost all of a noncircular sectional shape. As shown in FIG. 12, the interior of the developer cartridge 45 is partitioned into a developer containing portion 53 for containing a new developer 52 and a developer recovering portion 55 for recovering a used developer 54 by a cap 56 for partitioning. Further, although illustrated embodiment is such that the developer containing portion 53 occupies about 4/5 of the entire length of the developer cartridge 45 and the developer recovering portion 55 occupies about 1/5 thereof, the ratio of lengths of the developer containing portion 53 and the developer recovering portion 55 may vary.

Meanwhile, as shown in FIGS. 10 and 11, the sectional shape of the developer containing portion 53 of the developer cartridge 45 is noncircular. As shown in FIG. 11, the sectional shape of the developer containing portion 53 is substantially triangular with an angle of a corner portion 58 disposed at a top portion is set to be slightly small, and formed in a "rounded triangular" shape or substantially in a tear-drop shape with respective corner portions 57, 58, 59 formed in a circular arc shape. Explaining further, according to the sectional shape of the developer containing portion 53, the first corner portion 57 disposed at a lower end portion is formed in a circular arc shape having a relatively large radius, and a first and a second side face 60, 61 formed substantially in a planar shape are arranged in a V-like shape constituting an angle of about 60 degrees centering on the first corner portions 57. Further, the second corner portion 58 and the third corner portion 59 disposed at front ends of the first side face 60 and the second side face 61 are formed in a circular arc shape having a radius smaller than that of the first corner portion 57 such that the second corner portion 58 and the third corner portion 59 are provided with substantially the same radius. Further, as shown in FIG. 7, the third side face 62 connecting the second corner portion 58 and the third corner portion 59 is formed in a circular arc shape having a large radius substantially equal to a radius of the flange member 42 on the front side of the developing apparatus 5.

Figure 11C:
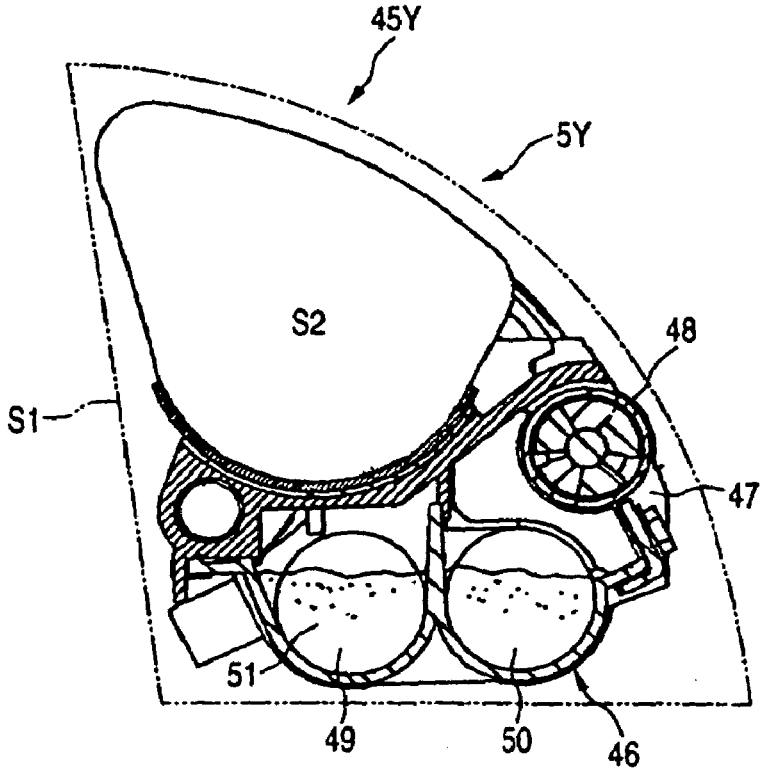
Figure 12:
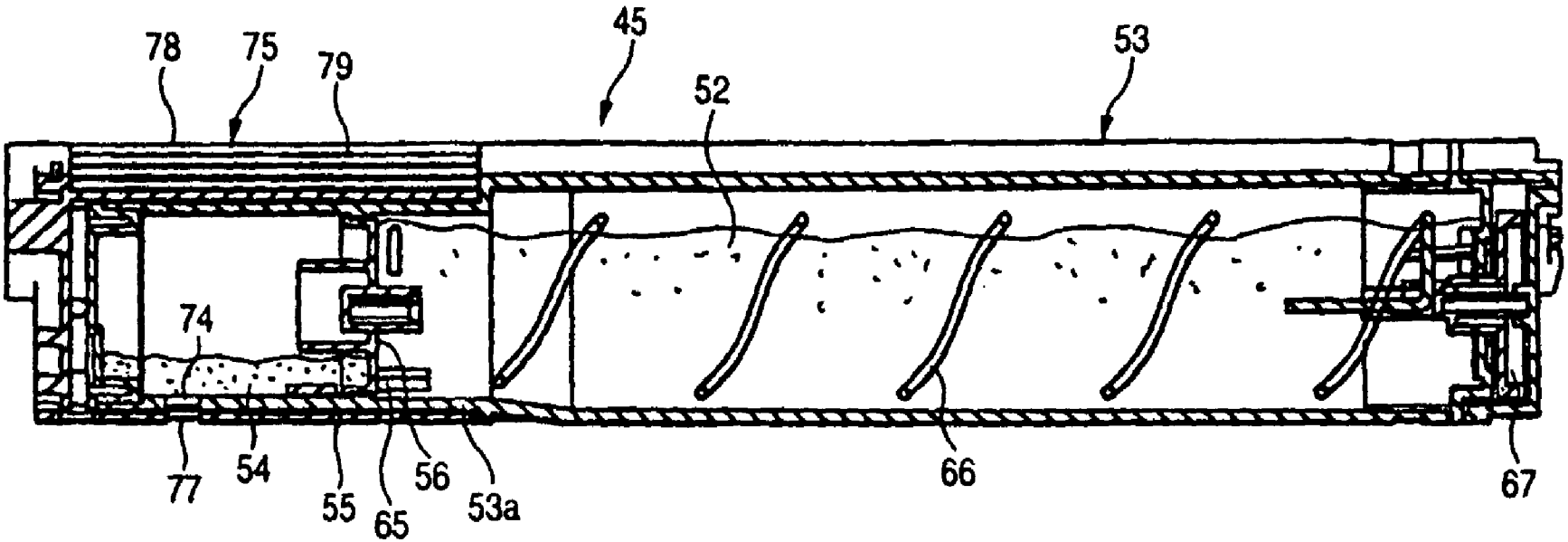
FIG. 12 is a sectional view showing the developer cartridge.

As a result, according to the developer containing portion 53 of the developer cartridge 45, as shown in FIG. 11C, the sectional shape of the developer containing portion 53 is formed by the noncircular shape substantially occupying all of a space S2 other than the developing unit 5Y in a space S1 allocated to one developing unit 5Y of the developing unit main body 46 mounted with the developer cartridge 45 and therefore, the developer containing portion 53 can contain the developer 52 as much as possible even when a total of the developing apparatus 6 is downsized and the diameter of the developing apparatus 6 is set to be small.

Meanwhile, according to the developer recovering portion 55 continuously provided to one end portion of the developer containing portion 53, as shown in FIGS. 11A and 11C, the sectional shape is formed in a circular shape substantially inscribing the space S2 other than the developing unit 5 in the space S1 allocated to one developing unit 6 of the developing unit main body 46 mounted with the developer cartridge 45 and having a diameter slightly smaller than that of the space S2. As shown in FIG. 12, the developer recovering portion 55 is arranged with the cap for partitioning integrally formed with a circular cross-section at one end portion in the longitudinal direction of the developer containing portion 53 at the end portion of the developing portion recovering portion 55 proximate to the developing portion containing portion 53.

Further explaining, according to the developer containing portion 53, as shown in FIG. 12, the end portion proximate to the developer recovering portion 55 is formed to be slightly slender to be continuously provided to the developer recovering portion 55 formed in a cylindrical shape. As a result, an end portion 53*a* of the developer containing portion 53 proximate to the developer recovering portion 55 is formed in a cylindrical shape the same as that of the developer recovering portion 55. As shown in FIG. 12, the cylindrical shape portion 53*a* of the developer containing portion 53 is opened with a supply port 65 for supplying the new developer 52 at an end portion on a side of the developer recovering portion 55 in a rectangular shape at a slightly inclined position. Further, inside of the developer containing portion 53 is rotatably arranged with an agitator 66 in a spiral shape for carrying the new developer 52 contained inside the developer containing portion 53 while agitating the new developer 52 and the developer 52 is carried by the agitator 66 to supply to outside from the supply port 65. Further, a gear 67 for driving to rotate the agitator 66 is provided at an end portion on the rear side of the developer cartridge 45 to expose a portion thereof to outside. As shown in FIG. 9, the gear 67 is constituted to mesh with a gear 67*a* provided at the developing unit main body 46 to drive the agitator 66.

As shown in FIG. 9, the developing unit 5Y supplied with the developer 52 from the developer cartridge 45 is provided with a shutter plate 68 on a side of the developing unit brought into contact with a portion in correspondence with the supply port 65 of the developer cartridge 45 in a state of being bent substantially in a circular shape. The shutter plate 68 is mounted to the developing unit main body 46 slidably along an arrow mark direction. Further, the shutter plate 68 is opened with a replenish receive port 69 for receiving the new developer 52 supplied from the developer cartridge 45 and an end portion on an outer peripheral side of the replenish receive port 69 is projected with a projected piece 69*a* to direct to an inner side. As shown in FIG. 8 and FIG. 9, in the developing unit 5Y replenished with the developer 52 from the replenish receive port 69, the new developer 52 is carried by a predetermined distance along the longitudinal direction of the developing unit main body 46 by a replenishing auger 71 arranged over a predetermined length on an upper side of a rear face side of the developing unit main body 46 and having a replenish port of the developer at an inlet thereof and thereafer replenished to inside of the developing unit main body 46 from replenishing opening portion, not illustrated, provided on the upper side on the rear face side of the developing unit main body 46.

Figure 8B:
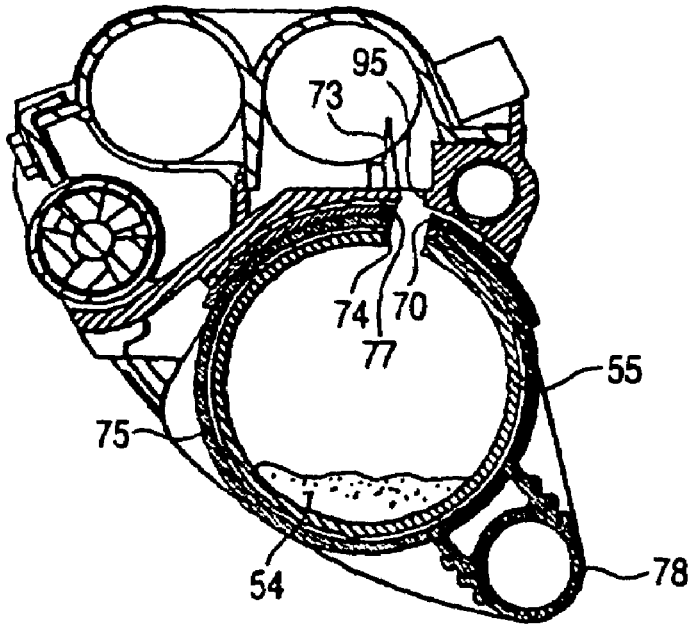
Figure 9:
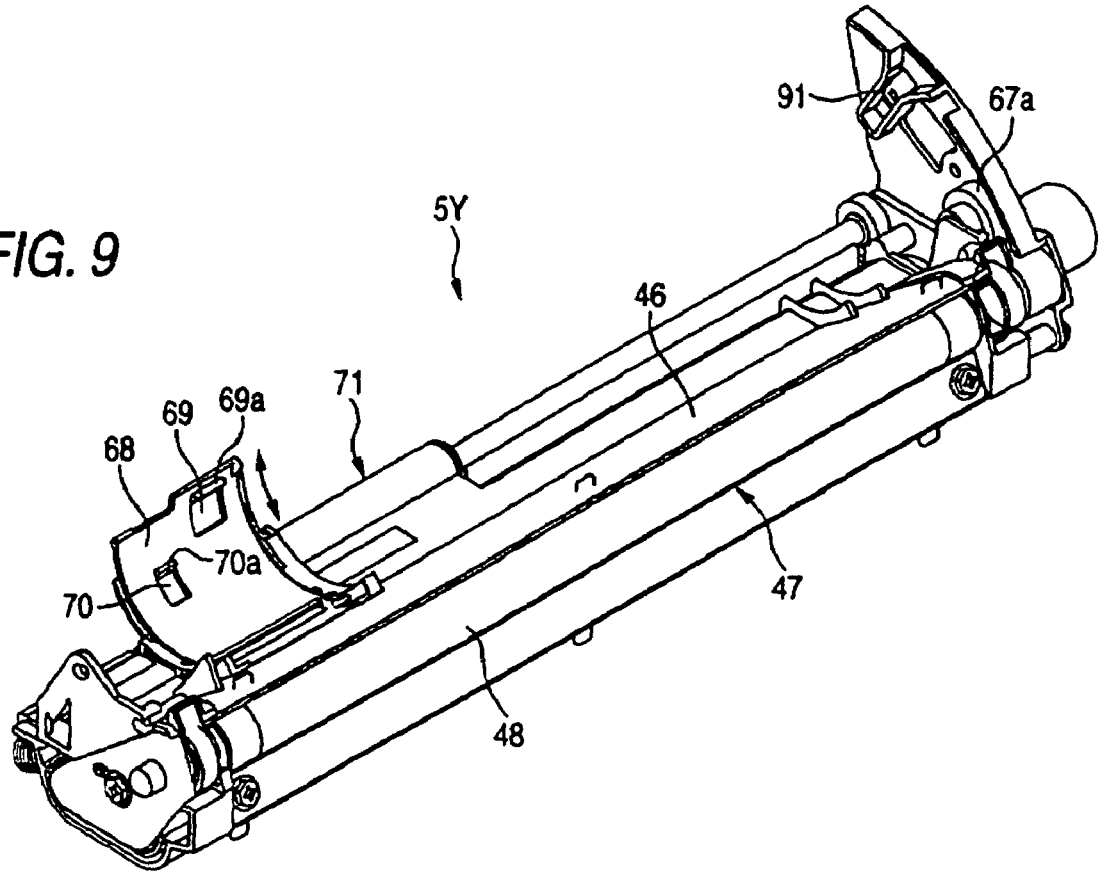
FIG. 9 is a perspective view showing the developing unit.

Further, as shown in FIG. 8B, the developing unit 5Y is provided with a recovering opening portion 95 on an upper side on the rear face side of the developing unit main body 46 to recover the used developer in the developer 51 contained inside the developing unit main body 46 and is constituted to recover a portion of the used developer 54 by opening a flap 73 when the developing unit 5Y is rotated to move to a position 5C of FIG. 4. As shown in FIG. 9, the developer 54 recovered from the developing unit 5 is constituted to recover into the developer recovering portion 55 of the developer cartridge 45 as shown in FIG. 8B via a recovering discharge port 70 opened at the shutter plate 68 as shown in FIG. 9 and a recover port 74 opened at the developer cartridge 45 as shown in FIG. 12. Further, also the recovering discharge port 70 of the developing unit is projected with a projected piece 70*a* to direct to the inner side as shown in FIG. 9.

Further, according to the embodiment, as shown in FIG. 8 and FIG. 12, a shutter member 75 as the opening and closing member for opening and closing the supply port 65 of the developer containing portion 53 and the recover port 74 of the developer recovering portion 55 is fitted to outer peripheries of the developer containing portion 53*a* and the developing recovering portion 55 formed in a cylindrical shape of the developer cartridge 45 pivotably along a peripheral direction. Although as shown in FIG. 8 and FIG. 10, the shutter member 75 is formed in the cylindrical shape similar to the developer containing portion 53*a* and the developer storing portion 55 of the developer cartridge 45, an inner diameter of the shutter member 75 is slightly larger than an outer diameter of the developer recovering portion 55 and is formed in a circular shape substantially inscribing the space S2 other than the developing unit 5Y in the space S1 allocated to one developing unit 5Y of the developer apparatus main body 46 mounted with the developer cartridge 45 as shown in FIG. 8 and FIG. 11C.

Figure 13:
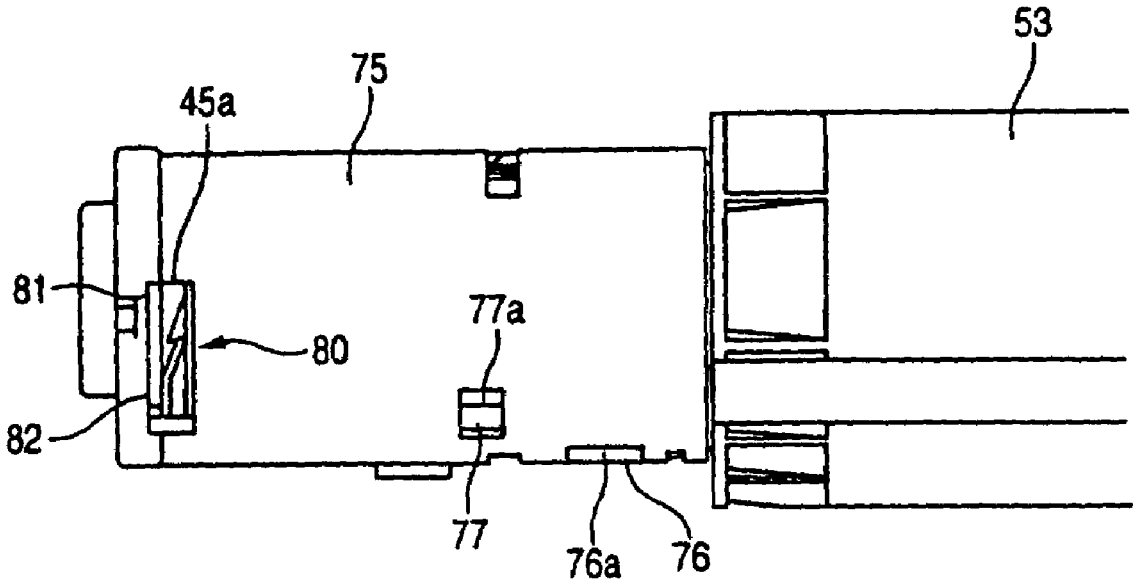
FIG. 13 is a bottom view showing a portion of the developer cartridge.

As shown in FIG. 8 and FIG. 12, FIG. 13, the shutter member 75 is opened with a supplying opening portion 76 and a recovering opening portion 77 at positions corresponding to the supply port 65 and the recovery port 74 of the developer cartridge 45 and the shutter member 75 can simultaneously open and close the supply port 65 and the recover port 74 of the developer cartridge 45 by being pivoted along an outer periphery of the developer recovering portion 55 of the recovering agent cartridge 45. Further, projected pieces 76*a* and 77*a* are projected to direct to an outer side at end edges of the supplying opening portion 76 and the recovering opening portion 77 of the shutter member 75.

Further, as shown in FIG. 10, the shutter member 75 is projected with a handle 78 for operating to pivot the shutter member 75 and grabbing the developer cartridge 45 to mount to the developing unit main body 46 to direct to an outer side in a radius direction at a portion in a peripheral direction thereof. As shown in FIG. 8A, the handle 78 has a radius of curvature coinciding with the second corner portion 58 of the developer containing portion 53 of the developer cartridge 45 in a state of mounting the developer cartridge 45 to the developing unit main body 46 and opening the shutter member 75. A side face of the handle 78 is provided with a non-slip portion 79 comprising a plurality of projected streaks to facilitate grabbing.

Further, as shown in FIG. 11A, the shutter member 75 is constituted to project the handle 78 at an outer periphery of the developing unit main body 46 in a state of operating to pivot the shutter member 75 in the clockwise direction and closing the supply port 65 and the recovery port 74 of the developer cartridge 45.

Figure 14:
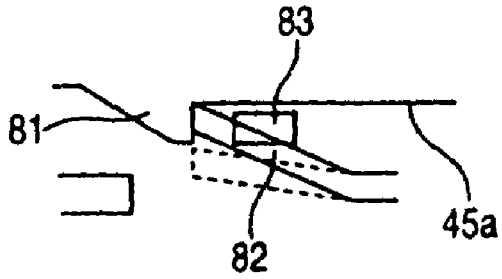
FIG. 14 is a detailed view showing a lock mechanism.
Figure 15:
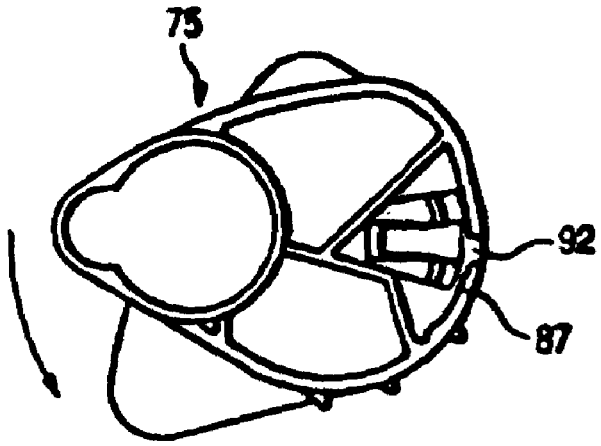
FIG. 15 is a section view showing operation of the lock mechanism of the developer cartridge.

Further, as shown in FIG. 13, the shutter member 75 is provided with a lock mechanism 80 for preventing the shutter member 75 from erroneously pivoting in a direction of opening the supply port 65 and the replenish port 74 of the developer cartridge 45 while removing the developer cartridge 45 from the developing unit main body 46. As shown in FIG. 14, the lock mechanism 80 comprises a butt portion 81 formed at an end face 45*a* on the front side of the developer cartridge 45 and an elastically deformable lock piece 82 projected at an inner face of the shutter member 75 for being locked by the butt portion 81. Further, the developer cartridge 45 is constituted such that when being removed from the developing unit main body 46, the lock piece 82 projected at the inner face of the shutter member 75 is locked by the butt portion 81 formed at the end face 45*a* on the front side of the developer cartridge 45 and the shutter member 75 is prevented from pivoting in the direction of opening the supply port 65 and the replenish port 74 of the developer cartridge 45 as shown in FIG. 15. Further, when the developer 45 is mounted to a predetermined position of the developing unit main body 46, as shown in a broken line of FIG. 14, the lock piece 82 of the developer cartridge 45 is elastically deformed by a projection 83 projected at a predetermined position of the developing unit main body 46 to release a state of being locked by the butt portion 81 and the shutter member 75 can be pivoted in the direction of opening the supply port 65 and the replenish port 74 of the developer cartridge 45.

Further, according to the embodiment, there is provided a stopper mechanism 85 for preventing the developer cartridge 45 from being removed from the developing unit main body 46 in a state in which the developer cartridge 45 is mounted to the predetermined position of the developing unit main body 46 and the shutter member 75 stays to be opened. The stopper mechanism 85 is constituted such that when the developer cartridge 45 is mounted to the predetermined position of the developing unit main body 46 and pivoted in a direction of opening the shutter member 75, as shown in FIG. 16, a lock plate portion 86 projected at a predetermined position of the developing unit main body 46 is locked by a locking recess portion 88 provided at an inner periphery of the flange portion 87 provided at the end face of the shutter member 75 and in state as it is, so far as the lock plate portion 86 projected at the developing unit main body 46 is brought into contact with the locking recess portion 88 to the shutter member 75 and is not pivoted in a direction of closing the shutter member 75, the developer cartridge 45 cannot be removed from the developing unit main body 46.

Figure 16:
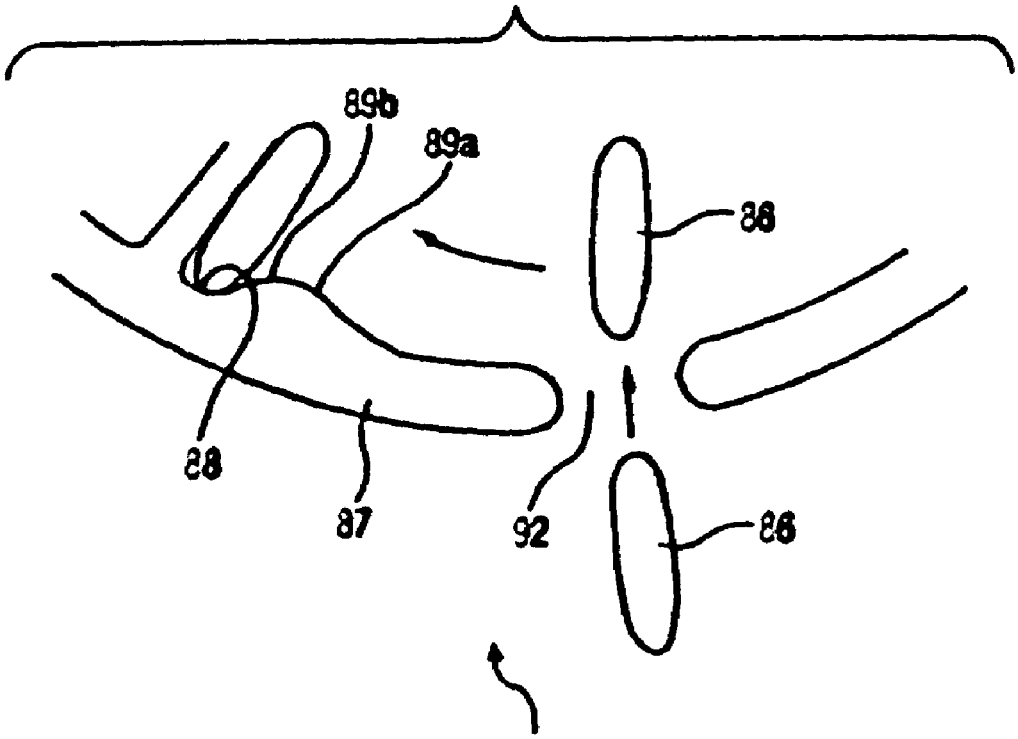
FIG. 16 is a detailed view showing a stopper mechanism.

Further, as shown in FIG. 16, the flange portion 87 of the shutter member 75 is formed with an inclined face 89*b* via a smoothly bent ridge portion 89*a* on this side of the locking recess portion 88 and when the lock plate portion 86 rides over the ridge portion 89*a* by pivoting the shutter member 75, the lock plate portion 86 is guided to the locking recess portion 88 by inclination of the inclined face 89*b* and the developer cartridge 45 can always firmly mounted to the predetermined position of the developing unit main body 46.

Figure 17:
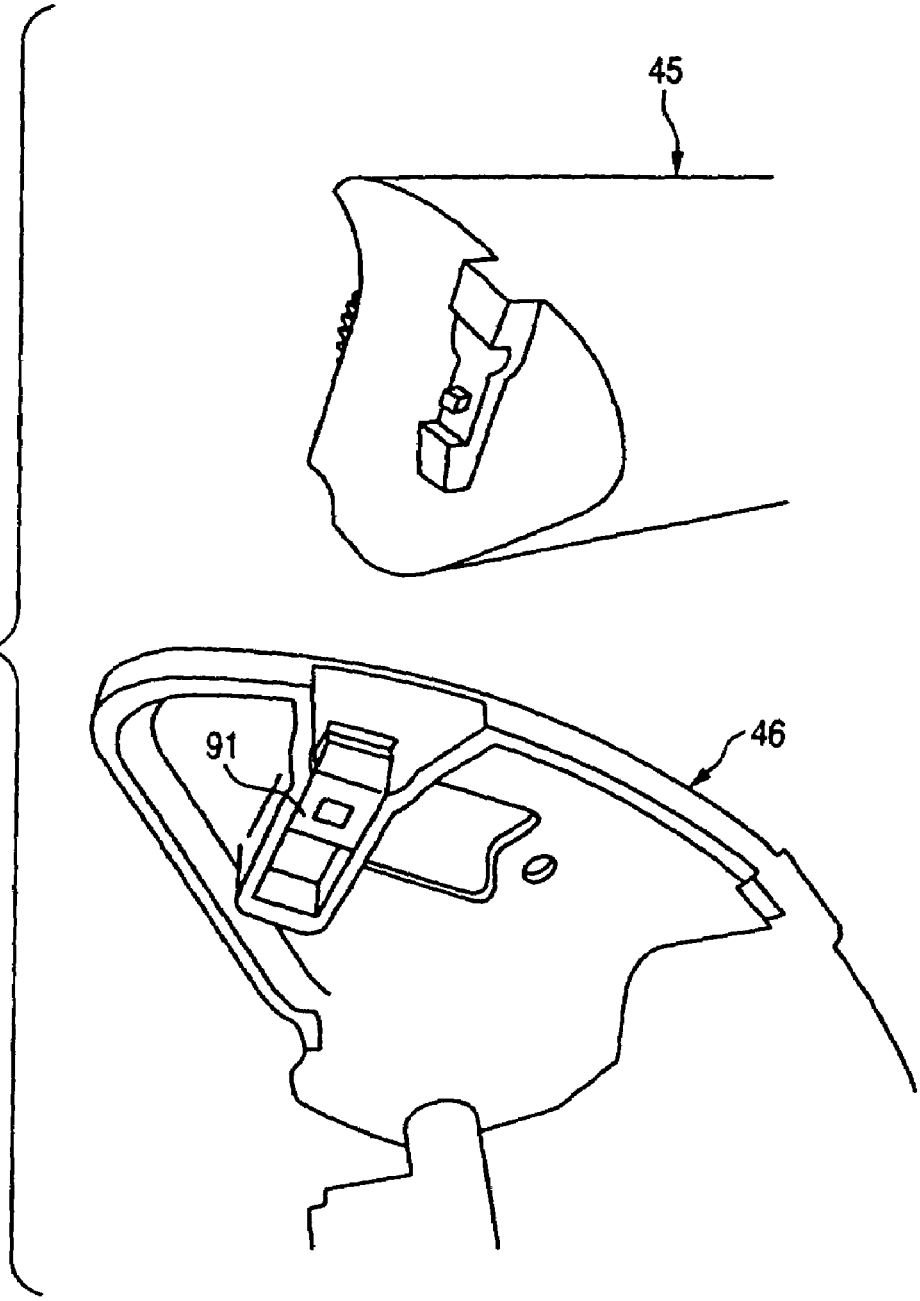
FIG. 17 is a detailed perspective view showing a guide mechanism of the developer cartridge.
Figure 18:
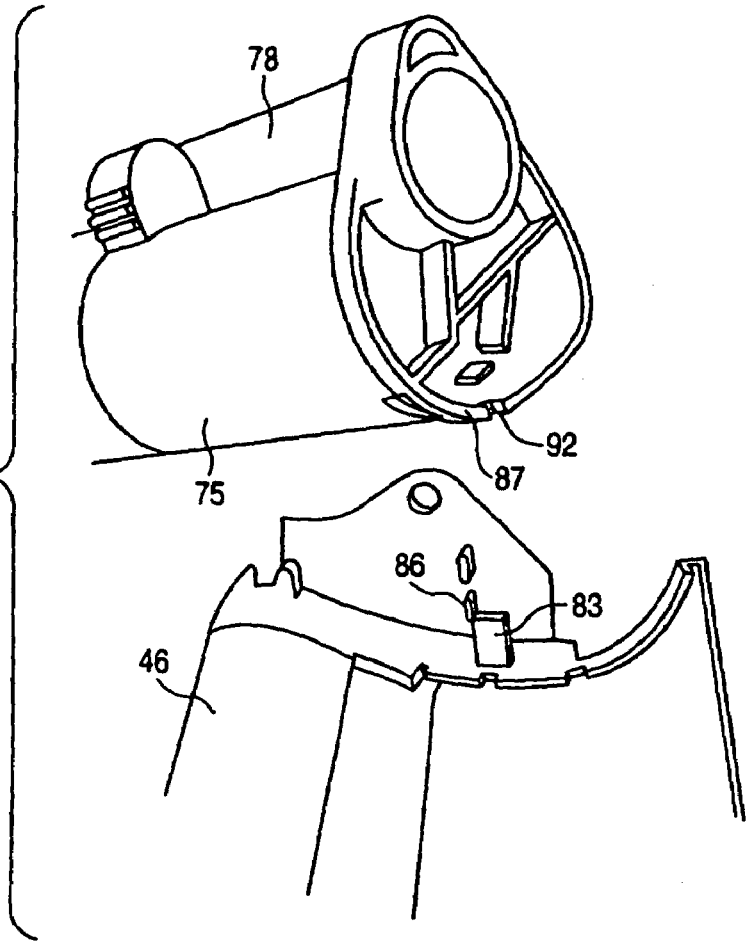
FIG. 18 is a detailed perspective view showing the guide mechanism of the developer cartridge.

Further, the embodiment is constituted such that in mounting the developer cartridge 45 to the predetermined position of the developing unit main body 46, by sliding the developer cartridge 45 from an outer side in a radial direction orthogonal to an axial direction of the developing unit main body 46 to a substantially central direction of the developing unit main body 46, as shown in FIG. 17, a slide portion projected at an end face on a depth side of the developer cartridge 45 is engaged with the engaging leaf spring 91 provided at a corresponding position of the developing unit main body 46 as shown in FIG. 9, and the lock plate portion 86 projected at the developing unit main body 46 is guided via a guiding gap 92 of the flange portion 87 of the shutter member 75 projected at an end face on a front side of the developing cartridge 45 as shown in FIG. 15 through FIG. 18.

In addition to the above-described arrangement, the image forming apparatus main body provides an operation hampering member for hampering operation of pivoting at least a portion of the developer cartridge which is not disposed at the interchanging position in a direction of opening the supply port in a state of taking out the image forming unit.

Further, according to the embodiment, at least a portion of the developer cartridge for opening and closing the supply port is constituted to be the handle provided at an opening and closing member for opening and closing the supply port.

That is, according to the embodiment, as shown in FIGS. 1, 7, 19, and 20, at the inner frames 1*a*, 1*b* of the printer main body 1, the projection 96 extends from the inner frame 1*a* in a longtitudinal direction of the developer cartridges 45 in the vicinity of one end portion (front side) of the rotating type developing unit 5 in its axial direction. The projection 96 functions as an operation hampering member for hampering the handle 78 of the developer cartridge 45 disposed at a position A (see FIG. 7), which is not the interchanging position B, from being rotated in the direction of removing the developer cartridge 45. The projection 96 is formed, for example, integrally with the inner frame 1*a*.

In the above-described configuration, according to the full color printer as the image forming apparatus according to the embodiment, even when the image forming apparatus is downsized, there is not a concern of contaminating inside or surrounding of the image forming apparatus by scattering the developer by mistakenly installing and removing the developer cartridge of the developing unit which is not disposed at the interchanging position when the image forming unit is removed by the following way.

According to the above-described full color printer, as shown in FIG. 2 and FIG. 7, operation of printing a color image is carried out by supplying the developer 52 of the predetermined colors from the developer cartridges 45Y, 45M, 45C, 45K mounted to the rotating type developing unit 5 to the corresponding developing units 5Y, 5M, 5C, 5K.

Meanwhile, according to the developer containing portion 53 of the developer cartridge 45, as shown in FIG. 4 and FIG. 8, FIG. 11, the sectional shape of the developer containing portion 53 is not constituted by the circular shape, in the space S1 allocated to one developing unit 5Y of the developing unit main body 46 mounted with the developer cartridge 45, substantially a total of the space S2 other than the developing unit 5Y is formed in the noncircular shape and therefore, the developer containing portion 53 can contain the developer 52 as much as possible even when the total of the developing apparatus 6 is downsized and the diameter of the developing apparatus 6 is set to be small.

Therefore, even when the rotating type developing unit 5 is downsized, the developer containing portion 53 of the developer cartridge 45 can contain the developer 52 as much as possible, for example, in the case of the image having the darkness of 5% in black and white monochrome, the developer cartridge 45 can print about 4000 sheets of A4 size sheet.

Next, according to the above-described full color printer, as shown in FIG. 2, when operation of printing a color image is continued, the developer 52 contained in the developer cartridge 45 mounted to the rotating type developing unit 5 is gradually consumed and when the developer 52 in the developer cartridge 45 is emptied, the developer cartridge 45 needs to be exchanged for a new one.

Figure 20:
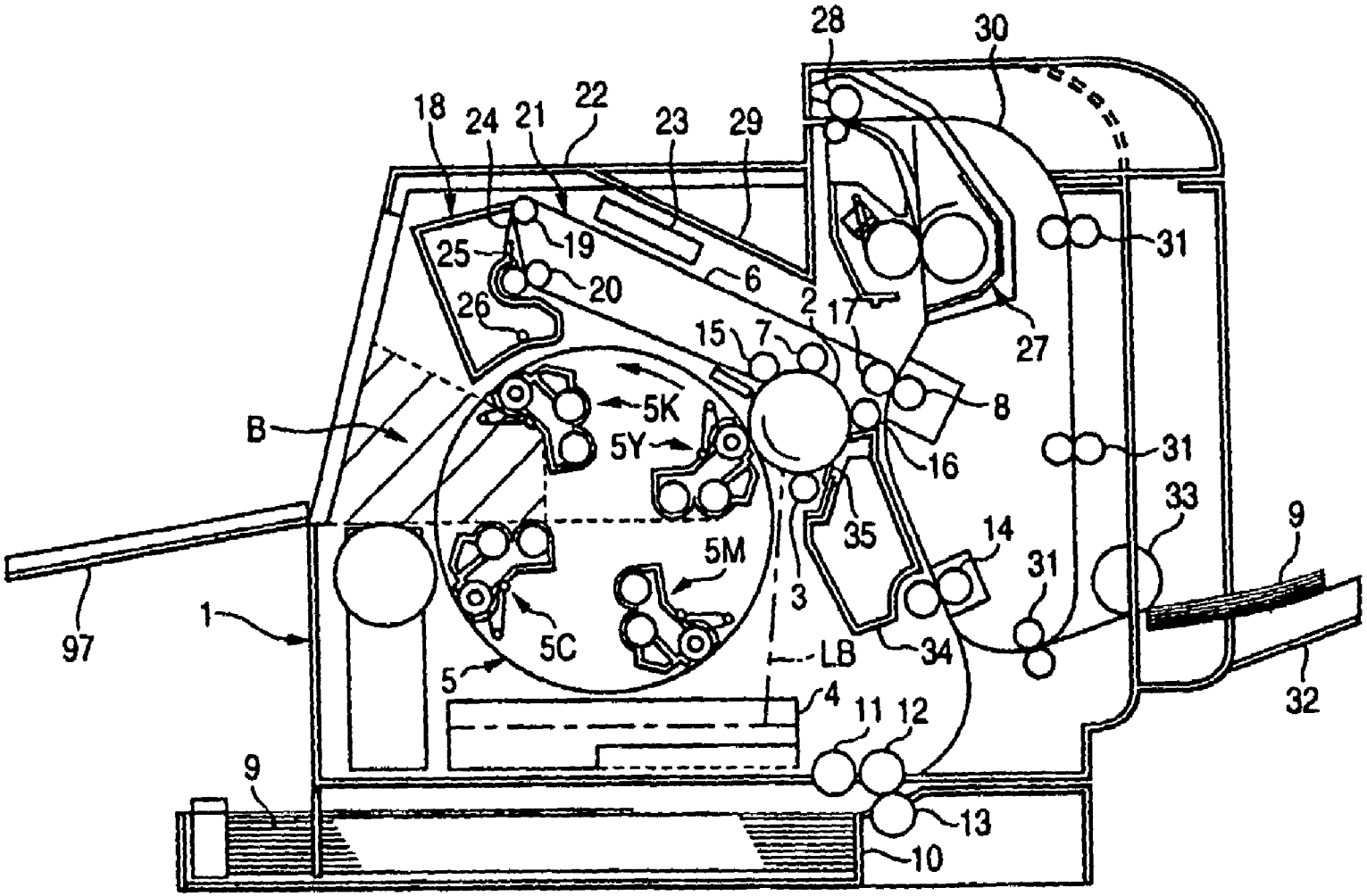
FIG. 20 is a section view showing a state of taking out the developer cartridge by opening a side cover of the full color printer of the image forming apparatus according to Embodiment 1 of the invention.
Figure 21:
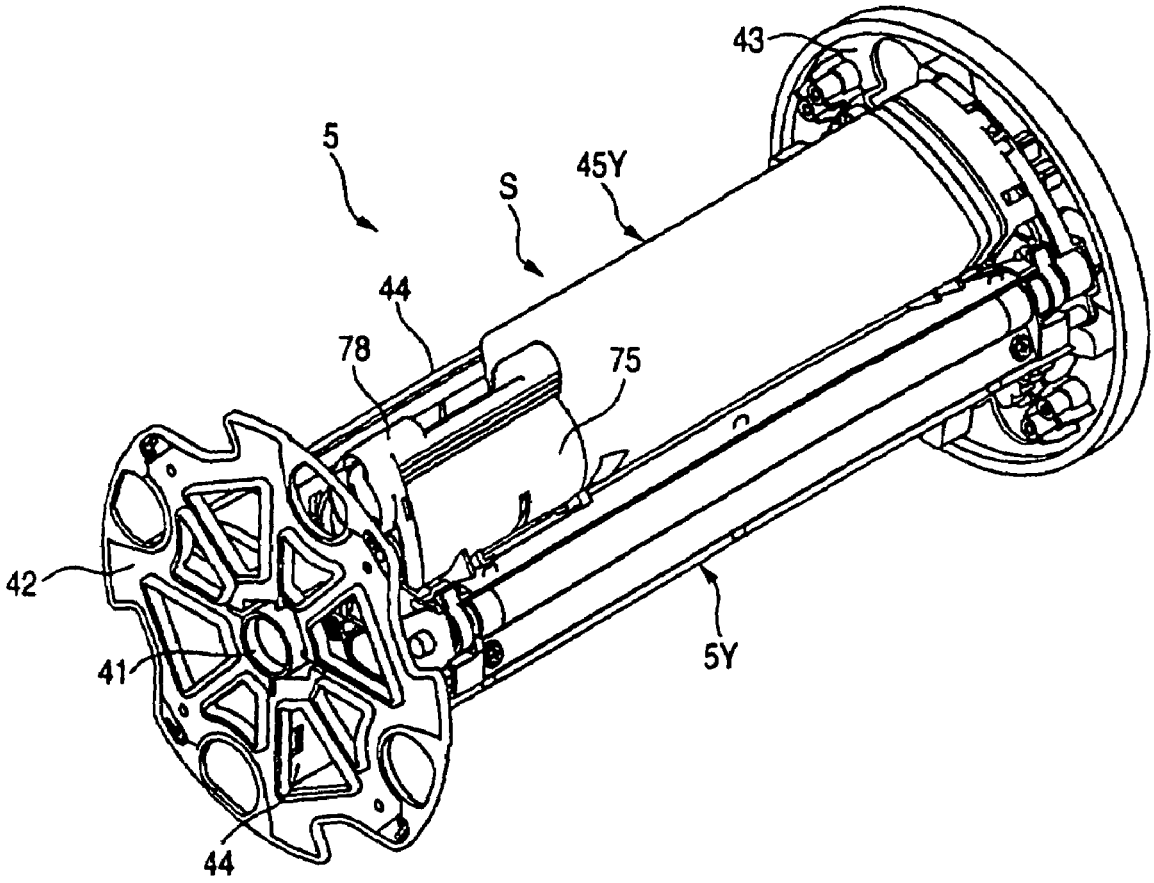
FIG. 21 is a perspective view showing the developing apparatus when the developer cartridge is taken out.

In this case, as shown in FIG. 20, the rotating type developing unit 5 is stopped such that the developer cartridge 45 to be exchanged is disposed at an interchanging position B, a side cover 97 provided at a side face of the printer main body 1 is opened, at a position indicated by B of FIG. 7, as shown in FIG. 1 and FIG. 20, the developer cartridge 45 to be interchanged is taken out. At this occasion, according to the developer cartridge 45, as shown in FIG. 21, the handle 78 of the shutter member 75 is grabbed by the hand and the shutter member 75 is gradually pivoted in the clockwise direction.

Then, according to the developer cartridge 45, as shown in FIG. 11A, in accordance with pivoting the shutter member 75, the supply port 65 and the replenish port 74 of the developer cartridge 45 are closed by the shutter member 75. At this occasion, as shown in FIG. 22, the developer 52 present at the supply port 65 of the developer cartridge 45 is brought into a state of being scraped to cut by an end edge of the opening portion 76 of the shutter member 75 and the supply port 65 of the developer cartridge 45 is closed in a state in which the developer is not interposed at the end edge of the opening portion 76 of the shutter member 75.

Figure 23A:
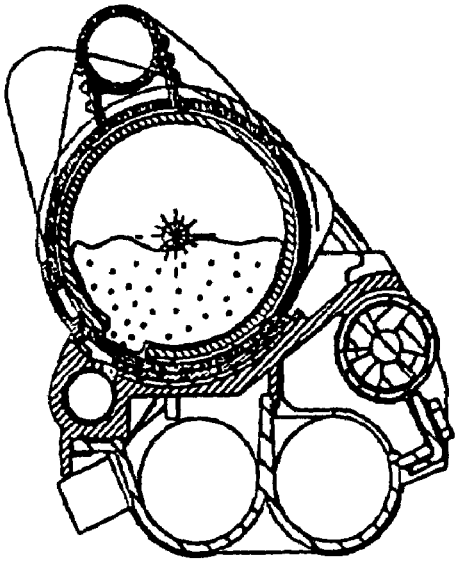
FIGS. 23A and 23B are sectional views showing the operation of opening and closing the shutter member of the developer cartridge.
Figure 23B:
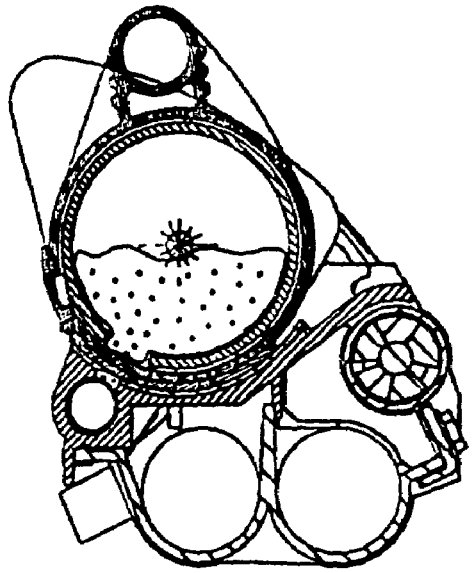
Figure 24:
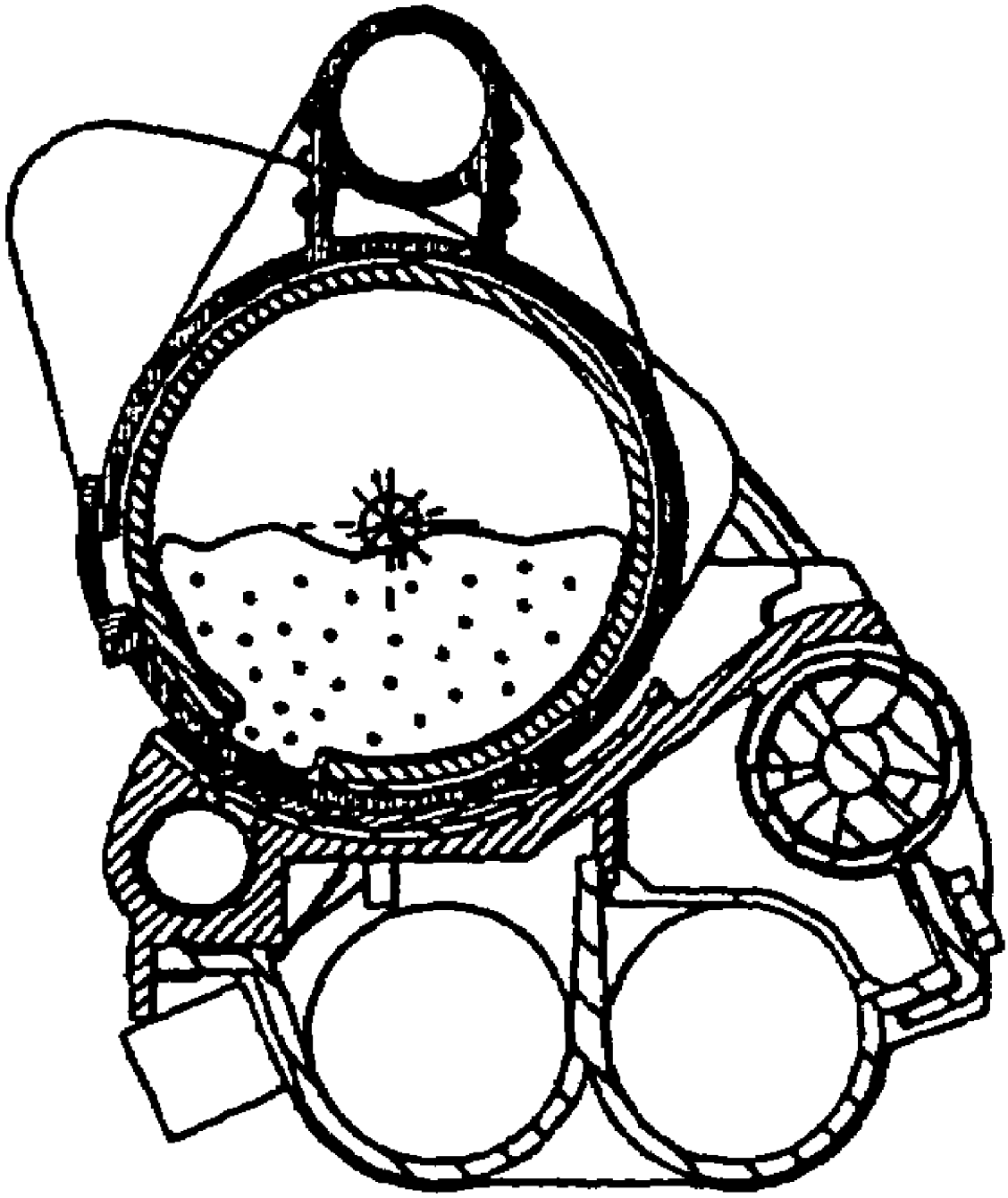
FIG. 24 is a sectional view showing the operation of opening and closing the shutter member of the developer cartridge.

According to the developer cartridge 45, as shown in FIG. 23 and FIG. 24, when the shutter member 75 is further pivoted, by the end edge of the opening portion 76 of the shutter member 75, the shutter plate 68 of the developing unit main body 46 is pivoted and the supply port 65 of the developing unit main body 46 is completely closed. Under the state, as shown in FIG. 16, the stopper mechanism 85 provided on the front side of the developer cartridge 45 is released. That is, the lock plate portion 86 projected at the predetermined position of the developing unit main body 46 is disengaged from the locking recess portion 88 of the flange portion 87 of the shutter member 75 and becomes movable via the guiding gap 92 of the flange member 87 and the developer cartridge 45 can be removed from the developing unit main body 46.

Further, by mounting the new developer cartridge 45 to the predetermined position of the developing unit main body 46 from the outer side substantially in the radius direction of the developing apparatus 5 to the center portion, the lock mechanism 80 of the developer cartridge 45 is released and the shutter member 75 of the developer cartridge 45 can be rotated in the counterclockwise direction.

Figure 22A:
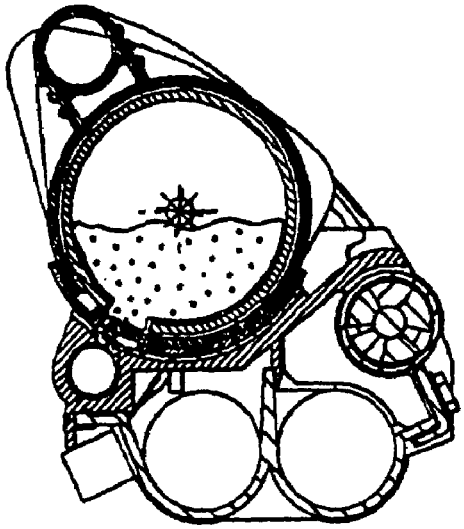
FIGS. 22A and 22B are sectional views showing operation of opening and closing a shutter member of the developer cartridge.
Figure 22B:
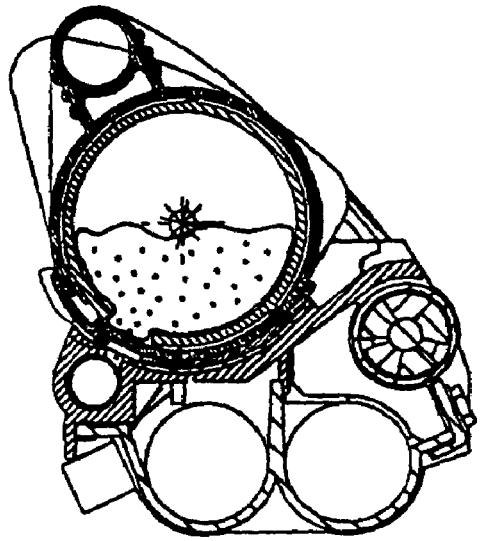

Then, according to the developer cartridge 45, as shown in FIGS. 22 through 24, by operation reverse to the operation of removing the developer cartridge 45, the developer cartridge 45 is mounted to the developing unit main body 46 and the supply port 65 and the replenish portion 74 of the developer cartridge 45 are opened by the shutter member 75.

Further, according to the above-described full color printer, as shown in FIG. 4, there is a case of removing the image forming unit 21 from the printer main body 1 for removing the jammed record sheet 9, maintenance or the like. Then, according to the above-described full color printer, as shown in FIG. 4 and FIG. 7, the developer cartridge 45 of the developing unit which is disposed at the developing position which is not the interchanging position is exposed to outside and there is a concern that the user erroneously takes out the developer cartridge 45 disposed at the developing position A which is not the interchanging position (position B of FIG. 7) for interchange or the like.

Figure 19:
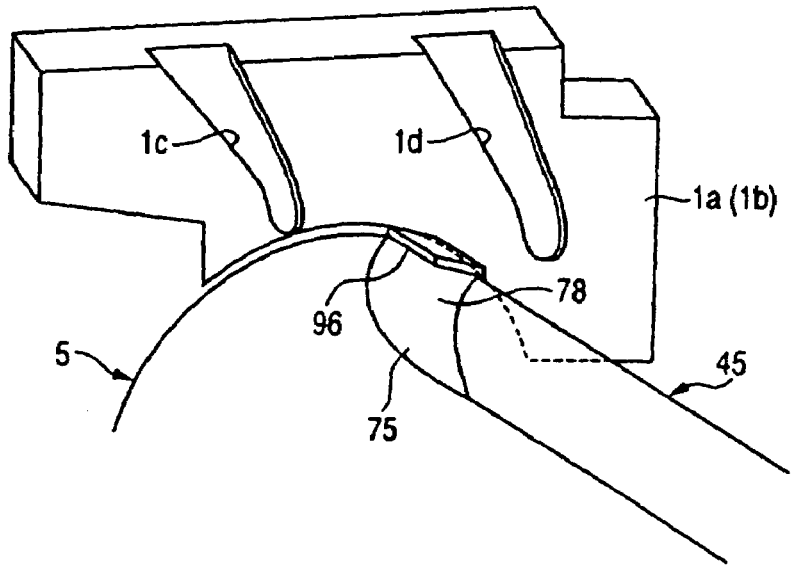
FIG. 19 is a perspective view showing a portion of the full color printer of the image forming apparatus according to Embodiment 1 of the invention.

Meanwhile, according to the embodiment, as shown in FIG. 1 and FIG. 19, the frame 1*a* of the printer main body 1 is provided with the projection 96 for preventing the developer cartridge 45 of the developing unit disposed at the developing position A which is not the interchanging position (position B of FIG. 7) from being taken out in error.

Figure 25B:
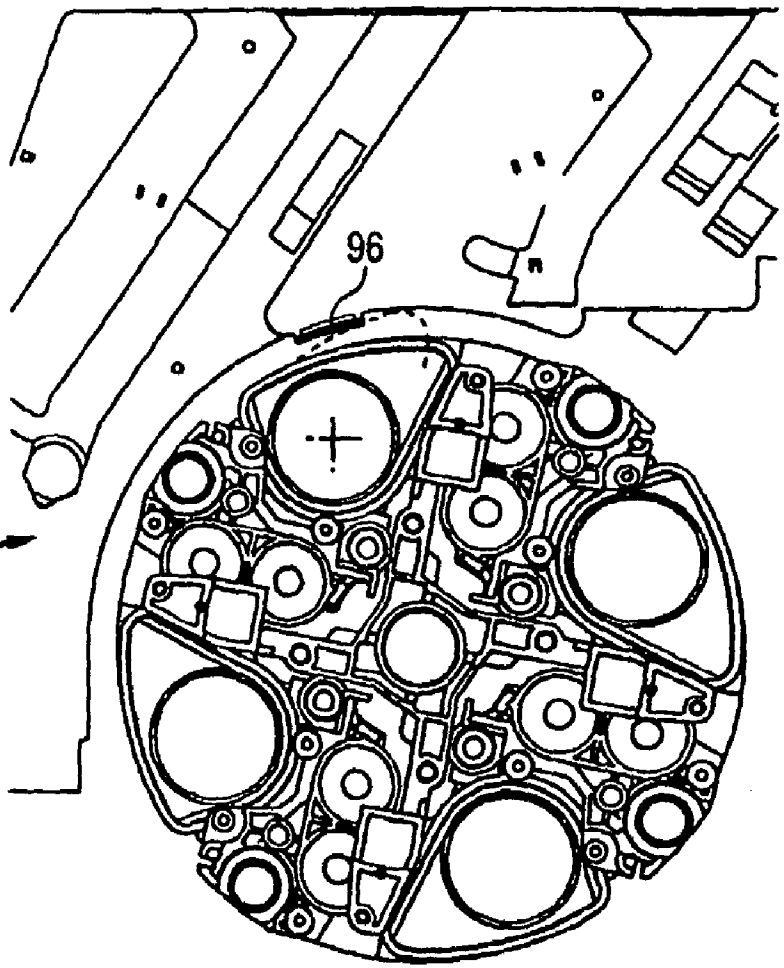
FIGS. 25A and 25B are an explanatory views showing operation of the full color printer of the image forming apparatus according to Embodiment 1 of the invention.
Figure 25A:
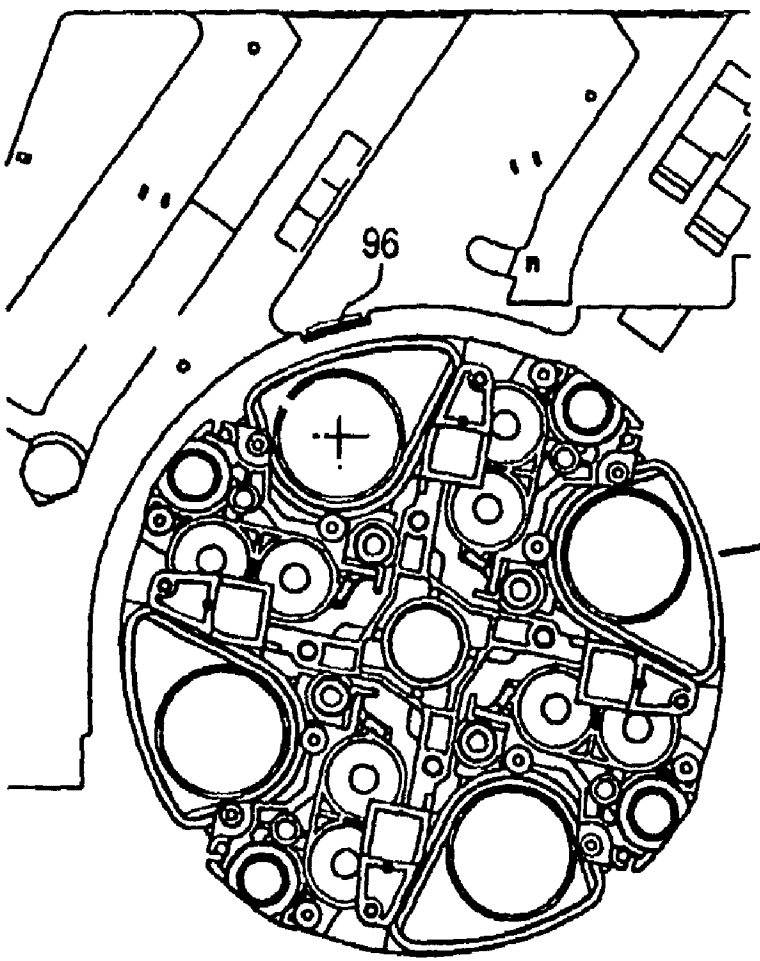
Figure 26:
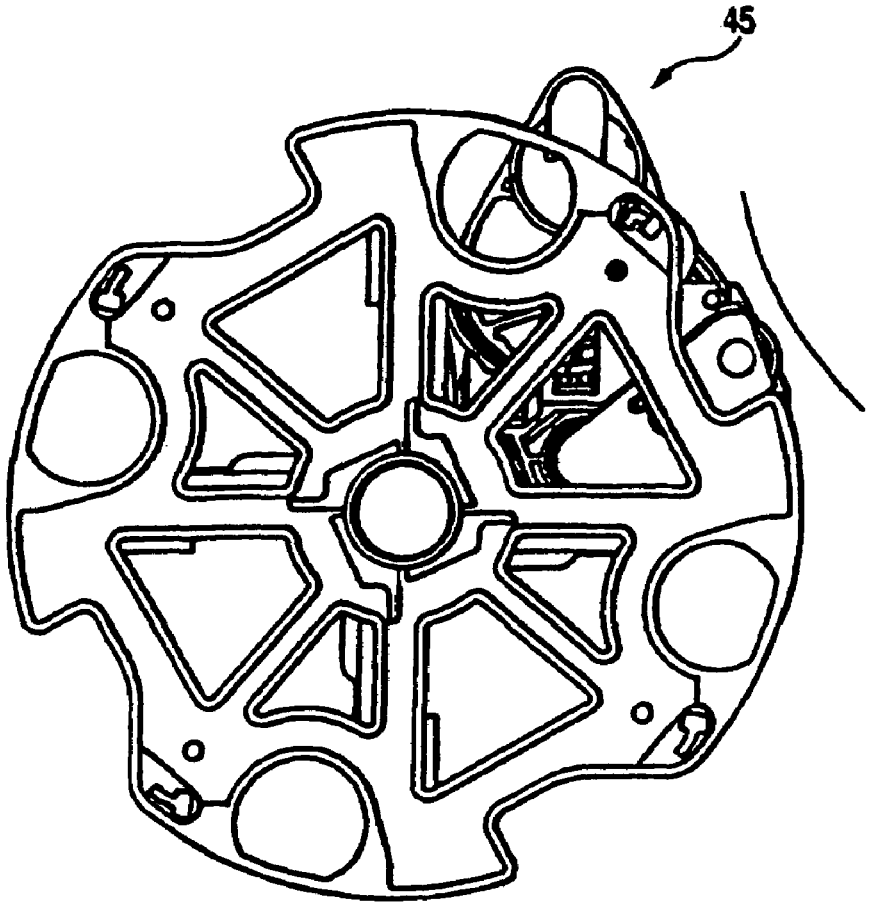
FIG. 26 is a side view showing the operation of the full color printer of the image forming apparatus according to Embodiment 1 is of the invention.
Figure 27:
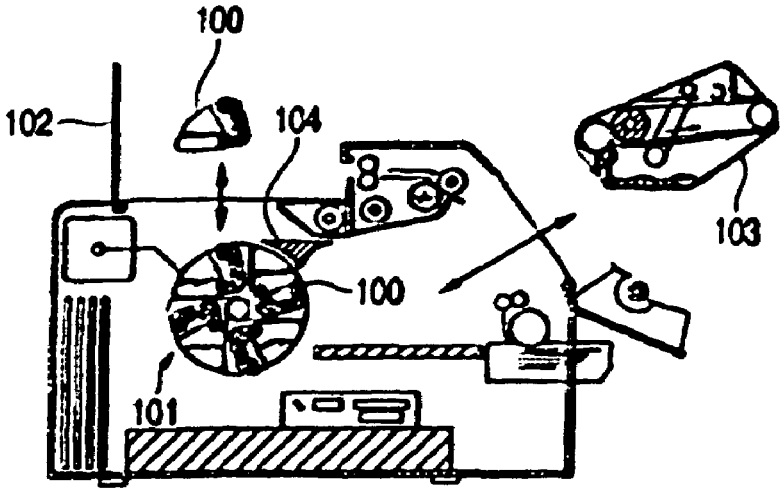
FIG. 27 is a section view showing an image forming apparatus of a prior art.

Therefore, even when the user mistakenly intends to take out the developer cartridge 45 disposed at the developing position A which is not the interchanging position (position B of FIG. 7), as shown in FIG. 25 and FIG. 26, the handle 78 of the developer cartridge 45 is hampered from being pivoted by the projection 96 and cannot be operated to pivot. Therefore, so far as the developer cartridge 45 is not pivoted to the interchanging position, the handle 78 cannot be pivoted in the direction of taking out the developer cartridge 45, the stopper mechanism 85 is not released and therefore, the developer cartridge 45 can firmly be prevented from being taken out in error.

In this way, in the case of the above-described full color printer, even when the printer main body 1 is downsized by arranging the image forming unit 21 at the surrounding of the rotating type developing unit 5 or the like, is the situation of mistakenly installing or removing the developer cartridge 45 which is not at interchanging position when the image forming unit 21 is removed can be avoided, thus preventing scattering of the developer and contamination of the inside or surrounding of the printer main body 1.

Further, even when the image forming unit 21 is removed from the printer main body 1 by opening the cover, the developer cartridge 45 disposed at a position C or a position D which is not the interchanging position in FIG. 7 is not exposed to outside and therefore, there is not a concern that the user erroneously takes out the developer cartridge 45.

Further, although according to the embodiment, an explanation has been given of the case of constituting to operate to install or remove the developer cartridge 45 by operating to pivot the handle 78 of the developer cartridge 45, the embodiment is not limited thereto but the developer cartridge 45 may be constituted to operate to remove or install by forming the sectional shape of the developer cartridge 45 to the noncircular shape and operating to pivot the total of the developer cartridge 45.

What is claimed is:

1. A developer cartridge for supplying a toner-containing developer, and for removable mounting in one of a plurality of developing units that are disposed along a rotating outer peripheral surface of a developing unit main body, the developer cartridge comprising:

a developer containing portion that contains the developer supplied to a developing unit;

a developer recovery portion, disposed at one end of the developer containing portion in a longitudinal direction, that recovers a used developer from the developing unit;

a supply port that opens to supply the developer from the developer containing portion to the developing unit;

a recovery port that opens in the developer recovery portion to recover the used and recovered developer from the developing unit;

a shutter member in which a supplying opening portion is formed at a position corresponding to the supply port and a recovering opening portion is formed at a position corresponding to the recovery port, the shutter member opening the supply port and the recovery port, and the shutter member closing the supply port and the recovery port; and a handle that operates the shutter member, the handle configured so that it is contained in the rotating outer peripheral surface of the developing unit main body when the supply port and the recovery port are opened, the handle configured so that it projects toward the outside of the rotating outer peripheral surface of the developing unit main body when the supply port and the recovery port are closed; and the handle further used to mount the developer cartridge on the developer unit main body.

2. The developer cartridge according to claim 1, wherein the shutter member is formed in a cylindrical shape that is rotatably fitted to an outer periphery of the developer containing portion and the developer recovery portion.

3. The developer cartridge according to claim 2, wherein the handle is configured to project outwardly in a radial direction from a portion of an outer peripheral surface of the shutter member.

4. The developer cartridge according to claim 1, wherein the handle is integrated with the shutter member.

5. The developer cartridge according to claim 1, wherein:

the developer recovery portion is continuously provided to the end of the developer containing portion, and the developer recovery portion and the developer containing portion are partitioned with a partitioning cap.

6. The developer cartridge according to claim 1, wherein the developer cartridge is removably mounted on one of the plurality of developing units in a direction vertical to a rotating axis of the developing unit main body.

7. The developer cartridge according to claim 1, wherein the shutter member opens the supply port and the recovery port simultaneously.

8. The developer cartridge according to claim 1, wherein the shutter member closes the supply port and the recovery port simultaneously.

* * * * *